US011315480B2

(12) United States Patent
Liu

(10) Patent No.: US 11,315,480 B2
(45) Date of Patent: Apr. 26, 2022

(54) PIXEL DRIVING CIRCUIT, DRIVING METHOD THEREOF, AND DISPLAY PANEL

(71) Applicant: BOE TECHNOLOGY GROUP CO., LTD., Beijing (CN)

(72) Inventor: Dongni Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 75 days.

(21) Appl. No.: 16/634,332

(22) PCT Filed: Jan. 25, 2019

(86) PCT No.: PCT/CN2019/073219

§ 371 (c)(1),
(2) Date: Jan. 27, 2020

(87) PCT Pub. No.: WO2020/151007

PCT Pub. Date: Jul. 30, 2020

(65) Prior Publication Data

US 2021/0225262 A1 Jul. 22, 2021

(51) Int. Cl.
*G09G 3/32* (2016.01)
*G09G 3/20* (2006.01)

(52) U.S. Cl.
CPC ..... *G09G 3/32* (2013.01); *G09G 3/2022* (2013.01); *G09G 2300/0819* (2013.01);
(Continued)

(58) Field of Classification Search
CPC ..... G09G 3/2022; G09G 3/32–3291; G09G 2300/0819; G09G 2300/0852;
(Continued)

(56) References Cited

U.S. PATENT DOCUMENTS 8,059,071 B2 11/2011 Kim et al.
9,412,307 B2 8/2016 Kwon et al.
(Continued)

FOREIGN PATENT DOCUMENTS

CN 101123071 A 2/2008
CN 104252835 A 12/2014
(Continued)

OTHER PUBLICATIONS

International Search Report of PCT/CN2019/073219, dated Oct. 24, 2019 with English translation.
(Continued)

*Primary Examiner* — Gene W Lee
(74) *Attorney, Agent, or Firm* — Collard & Roe, P.C.

(57) ABSTRACT

Provided are a pixel driving circuit, a driving method thereof, and display panel. The pixel driving circuit includes a current control circuit and a time control circuit, wherein the current control circuit is configured to receive a display data signal and control a magnitude of a driving current flowing through the current control circuit according to the display data signal; the time control circuit is configured to receive the driving current, and receive a time data signal, a first light-emitting control signal and a second light-emitting control signal, and control a flowing time period of the driving current according to the time data signal, the first light-emitting control signal and the second light-emitting control signal.

20 Claims, 12 Drawing Sheets

(52) U.S. Cl.
CPC ..... *G09G 2300/0852* (2013.01); *G09G 2300/0861* (2013.01); *G09G 2310/0262* (2013.01); *G09G 2310/0286* (2013.01); *G09G 2310/08* (2013.01); *G09G 2320/0233* (2013.01); *G09G 2320/045* (2013.01)

(58) Field of Classification Search
CPC ... G09G 2300/0861; G09G 2310/0262; G09G 2310/08; G09G 2320/0233; G09G 2320/045
See application file for complete search history.

(56) References Cited

U.S. PATENT DOCUMENTS

| | | | | |
|---|---|---|---|---|
| 2012/0127220 | A1 | 5/2012 | Noguchi | |
| 2013/0201172 | A1* | 8/2013 | Jeong ..... | G09G 3/3258 345/212 |
| 2014/0104326 | A1 | 4/2014 | Roh | |
| 2014/0111563 | A1* | 4/2014 | Hwang ..... | H04N 13/398 345/691 |
| 2019/0096317 | A1 | 3/2019 | Chen et al. | |
| 2020/0090591 | A1 | 3/2020 | Wang et al. | |

FOREIGN PATENT DOCUMENTS

| | | | |
|---|---|---|---|
| CN | 106023900 | A | 10/2016 |
| CN | 107481664 | A | 12/2017 |
| CN | 107644613 | A | 1/2018 |
| CN | 108288456 | A | 7/2018 |
| CN | 108470537 | A | 8/2018 |
| CN | 108538241 | A | 9/2018 |
| CN | 108630151 | A | 10/2018 |

OTHER PUBLICATIONS

Chinese Office Action in Chinese Application No. 201980000092.4 dated May 14, 2021 with English translation.

* cited by examiner

PIXEL DRIVING CIRCUIT, DRIVING METHOD THEREOF, AND DISPLAY PANEL

CROSS REFERENCE TO RELATED APPLICATIONS

This application is the National Stage of PCT/CN2019/073219 filed on Jan. 25, 2019, the disclosure of which is incorporated by reference.

TECHNICAL FIELD

The embodiments of the present disclosure relate to a pixel driving circuit, a driving method thereof, and a display panel.

BACKGROUND

Display device of Micro light-emitting diode (Micro LED, mLED or μLED for short) has gradually attracted widespread attention, since it can reduce the length of light-emitting diode (LED) to 1% (for example, to less than 100 microns, such as 10 microns to 20 microns) and has the advantages of higher luminous brightness, luminous efficiency, and lower operating power consumption compared with display device of Organic Light-emitting Diode (OLED). Due to the above characteristics, Micro LED can be applied to devices having display functions such as mobile phones, displays, notebook computers, digital cameras, instruments and meters, etc.

Micro LED technology, that is, LED miniaturization and matricization technology can produce Micro LEDs which display red, green, and blue in micron scale on the array substrate. Currently, Micro LED technology is based on traditional gallium nitride (GaN) LED technology. Each Micro LED on the array substrate can be regarded as a separate pixel unit, that is, it can be driven and lighted individually, so that the display device presents a picture with higher exquisiteness and stronger contrast.

SUMMARY

A pixel driving circuit is provided in at least one embodiment of the present disclosure, which comprises: a current control circuit and a time control circuit, wherein the current control circuit is configured to receive a display data signal and control a magnitude of a driving current flowing through the current control circuit according to the display data signal; and the time control circuit is configured to receive the driving current, and receive a time data signal, a first light-emitting control signal and a second light-emitting control signal, and control a flowing time period of the driving current according to the time data signal, the first light-emitting control signal and the second light-emitting control signal.

For example, in the pixel driving circuit provided in an embodiment of the present disclosure, the time control circuit comprises: a switching circuit, a time data writing circuit, a first storage circuit, a first light-emitting control circuit, and a second light-emitting control circuit; the switching circuit comprises a control terminal and a first terminal, and is configured to be turned on or off to allow or not allow the driving current to pass through the switching circuit in response to the time data signal; the time data writing circuit is connected to the control terminal of the switching circuit, and is configured to write the time data signal to the control terminal of the switching circuit in response to a first scanning signal; the first storage circuit is connected to the control terminal of the switching circuit, and is configured to store the time data signal written by the time data writing circuit; the first light-emitting control circuit is connected to the first terminal of the switching circuit, and is configured to apply the driving current to the first terminal of the switching circuit in response to the first light-emitting control signal; and the second light-emitting control circuit is connected in parallel with the first light-emitting control circuit, and thus is also connected to the first terminal of the switching circuit, and is configured to apply the driving current to the first terminal of the switching circuit in response to the second light-emitting control signal.

For example, in the pixel driving circuit provided in an embodiment of the present disclosure, the time control circuit is connected to a light-emitting element, a time period for applying, by the first light-emitting control circuit and the switching circuit, the driving current to the light-emitting element to drive the light-emitting element to emit light is a first time period, a time period for applying, by the second light-emitting control circuit and the switching circuit, the driving current to the light-emitting element to drive the light-emitting element to emit light is a compensation time period, and the flowing time period is a sum of the first time period and the compensation time period.

For example, in the pixel driving circuit provided in an embodiment of the present disclosure, the switching circuit comprises a first transistor; a gate of the first transistor serves as the control terminal of the switching circuit, a first electrode of the first transistor serves as the first terminal of the switching circuit, and a second electrode of the first transistor is configured to be connected to the light-emitting element.

For example, in the pixel driving circuit provided in an embodiment of the present disclosure, the time data writing circuit comprises a second transistor; a gate of the second transistor is configured to be connected to a first scanning line to receive the first scanning signal, and a first electrode of the second transistor is configured to be connected to a time data line to receive the time data signal, a second electrode of the second transistor is configured to be connected to the control terminal of the switching circuit.

For example, in the pixel driving circuit provided in an embodiment of the present disclosure, the first storage circuit comprises a first capacitor; a first electrode of the first capacitor is configured to be connected to the control terminal of the switching circuit, a second electrode of the first capacitor is configured to be connected to a first voltage terminal to receive a first voltage.

For example, in the pixel driving circuit provided in an embodiment of the present disclosure, the first light-emitting control circuit comprises a third transistor; a gate of the third transistor is configured to be connected to a first light-emitting control line to receive the first light-emitting control signal, a first electrode of the third transistor is configured to be connected to the current control circuit, a second electrode of the third transistor is configured to be connected to the first terminal of the switching circuit.

For example, in the pixel driving circuit provided in an embodiment of the present disclosure, the second light-emitting control circuit comprises a fourth transistor; a gate of the fourth transistor is configured to be connected to a second light-emitting control line to receive the second light-emitting control signal, a first electrode of the fourth transistor is configured to be connected to the current control circuit, a second electrode of the fourth transistor is configured to be connected to the first terminal of the switching circuit.

For example, in the pixel driving circuit provided in an embodiment of the present disclosure, the current control circuit comprises a driving circuit, a display data writing circuit, and a second storage circuit; the driving circuit comprises a control terminal, a first terminal, and a second terminal, and is configured to control a magnitude of the driving current according to the display data signal; the display data writing circuit is connected to the first terminal or the control terminal of the driving circuit, and is configured to write the display data signal to the first terminal or the control terminal of the driving circuit in response to a second scanning signal; the second storage circuit is connected to the control terminal of the driving circuit, and is configured to store the display data signal written by the display data writing circuit.

For example, in the pixel driving circuit provided in an embodiment of the present disclosure, the current control circuit further comprises a compensation circuit, a third light-emitting control circuit, and a reset circuit; the compensation circuit is connected to the control terminal and the second terminal of the driving circuit, and is configured to compensate the driving circuit in response to the second scanning signal and the display data signal written to the first terminal of the driving circuit; the third light-emitting control circuit is connected to the first terminal of the driving circuit, and is configured to apply a second voltage of a second voltage terminal to the first terminal of the driving circuit in response to a third light-emitting control signal; the reset circuit is connected to the control terminal of the driving circuit, and is configured to apply a reset voltage of a reset voltage terminal to the control terminal of the driving circuit in response to a reset signal.

For example, in the pixel driving circuit provided in an embodiment of the present disclosure, the driving circuit comprises a fifth transistor; a gate of the fifth transistor serves as the control terminal of the driving circuit, a first electrode of the fifth transistor serves as the first terminal of the driving circuit, and a second electrode of the fifth transistor serves as the second terminal of the driving circuit and is configured to be connected to the time control circuit.

For example, in the pixel driving circuit provided in an embodiment of the present disclosure, the display data writing circuit comprises a sixth transistor; a gate of the sixth transistor is configured to be connected to a second scanning line to receive the second scanning signal, and a first electrode of the sixth transistor is configured to be connected to a display data line to receive the display data signal, a second electrode of the sixth transistor is configured to be connected to the first terminal or the control terminal of the driving circuit.

For example, in the pixel driving circuit provided in an embodiment of the present disclosure, the second storage circuit comprises a second capacitor; a first electrode of the second capacitor is configured to be connected to the control terminal of the driving circuit, a second electrode of the second capacitor is configured to be connected to the second voltage terminal to receive the second voltage.

For example, in the pixel driving circuit provided in an embodiment of the present disclosure, the compensation circuit comprises a seventh transistor; a gate of the seventh transistor is configured to be connected to a second scanning line to receive the second scanning signal, a first electrode of the seventh transistor is configured to be connected to the control terminal of the driving circuit, and a second electrode of the seventh transistor is configured to be connected to the second terminal of the driving circuit.

For example, in the pixel driving circuit provided in an embodiment of the present disclosure, the third light-emitting control circuit comprises an eighth transistor; a gate of the eighth transistor is configured to be connected to a third light-emitting control line to receive the third light-emitting control signal, a first electrode of the eighth transistor is configured to be connected to the second voltage terminal, a second electrode of the eighth transistor is configured to be connected to the first terminal of the driving circuit.

For example, in the pixel driving circuit provided in an embodiment of the present disclosure, the reset circuit comprises a ninth transistor; a gate of the ninth transistor is configured to be connected to a reset signal line to receive the reset signal, a first electrode of the ninth transistor is configured to be connected to the control terminal of the driving circuit, a second electrode of the ninth transistor is configured to be connected to the reset voltage terminal.

A display panel is also provided in at least one embodiment of the present disclosure, which comprises a plurality of pixel units arranged as an array, wherein the pixel unit comprises the pixel driving circuit according to any one of embodiments of the present disclosure and a light-emitting element connected to the pixel driving circuit.

For example, the display panel provided in an embodiment of the present disclosure further comprises at least two gate driving circuits, wherein the first light-emitting control signal and the second emitting control signal are respectively provided by different gate driving circuits of the at least two gate driving circuits.

For example, in the display panel provided in an embodiment of the present disclosure, the light-emitting element comprises a light-emitting diode.

A driving method for a pixel driving circuit according to any one of embodiments of the present disclosure is also provided in at least one embodiment of the present disclosure, which comprises: inputting the display data signal, the time data signal, the first light-emitting control signal, and the second light-emitting control signal, so that the current control circuit controls the magnitude of the driving current flowing through the current control circuit according to the display data signal, and the time control circuit receives the driving current and controls the flowing time period of the driving current according to the time data signal, the first light-emitting control signal and the second light-emitting control signal.

For example, in the driving method for the pixel driving circuit provided in an embodiment of the present disclosure, the flowing time period comprises a plurality of durations corresponding to different display gray levels, and the plurality of durations are binary unit durations.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

In order to make objects, technical solutions and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present invention belongs. The terms "first", "second", etc., used in the present disclosure, are not intended to indicate any sequence, amount or importance, but distinguish various components. Also, the terms "comprise", "include", etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On", "under", "right", "left" and the like are only used to indicate relative position relationship, and when the position of the object which is described is changed, the relative position relationship may be changed accordingly.

Micro LED is a kind of self-luminous device, its luminous efficiency will decrease as the current density decreases at low current density, and the color coordinate will also change as the current density changes. Therefore, Micro LED needs to realize gray-scale display under high current density to avoid large changes in luminous efficiency and color coordinates.

Figure 1A:
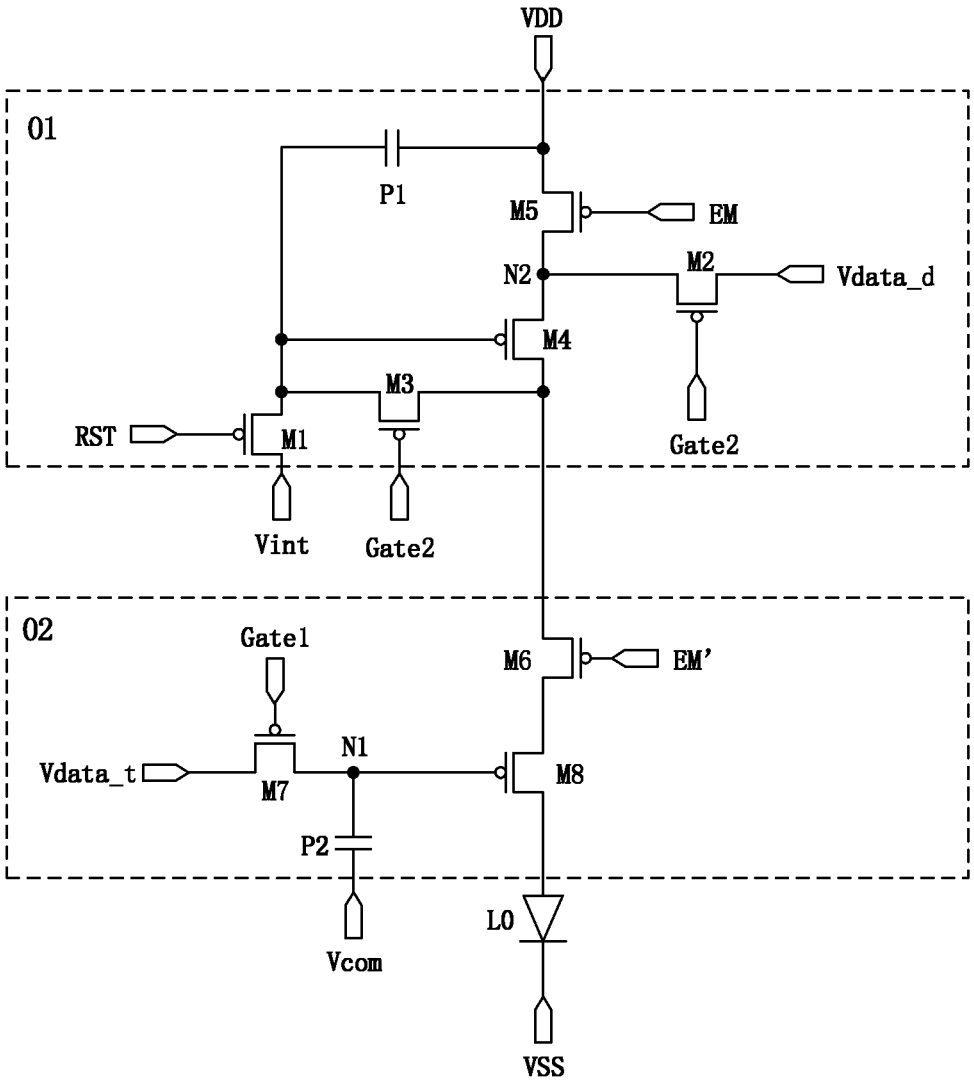
FIG. 1A is a schematic diagram of a pixel driving circuit.

The pixel driving circuit usually applied to Micro LED adopts an 8T2C circuit, that is, 8 thin film transistors (TFT) and 2 capacitors are used to realize the basic function of driving Micro LED to emit light. As shown in FIG. 1A, the pixel driving circuit is an 8T2C circuit, and includes a current control sub-circuit 01 and a duration control sub-circuit 02. The pixel driving circuit modulates a gray scale by a current magnitude and a light-emitting time. For example, the current control sub-circuit 01 includes first to fifth transistors M1-M5 and a first capacitor P1, in which the fourth transistor M4 is a driving transistor and the remaining transistors are switching transistors. These transistors and the first capacitor P1 cooperate to control the magnitude of current (i.e., driving current) flowing through the light-emitting element L0 (i.e., Micro LED). For example, the threshold voltage of the fourth transistor M4 can be compensated, thereby achieving a uniform current output. For example, the duration control sub-circuit 02 includes sixth to eighth transistors M6-M8 and a second capacitor P2, in which these transistors and the second capacitor P2 cooperate to control the light-emitting time of the light-emitting element L0. For example, each frame of picture may be formed by superposing two or more sub-pictures. Correspondingly, each frame of picture needs to perform two or more time data signal writing operations through the duration control sub-circuit 02. In this way, the Micro LED can work in a region with higher efficiency under full grayscale, and the color coordinates of the Micro LED in the region with higher efficiency have less drift.

Figure 1B:
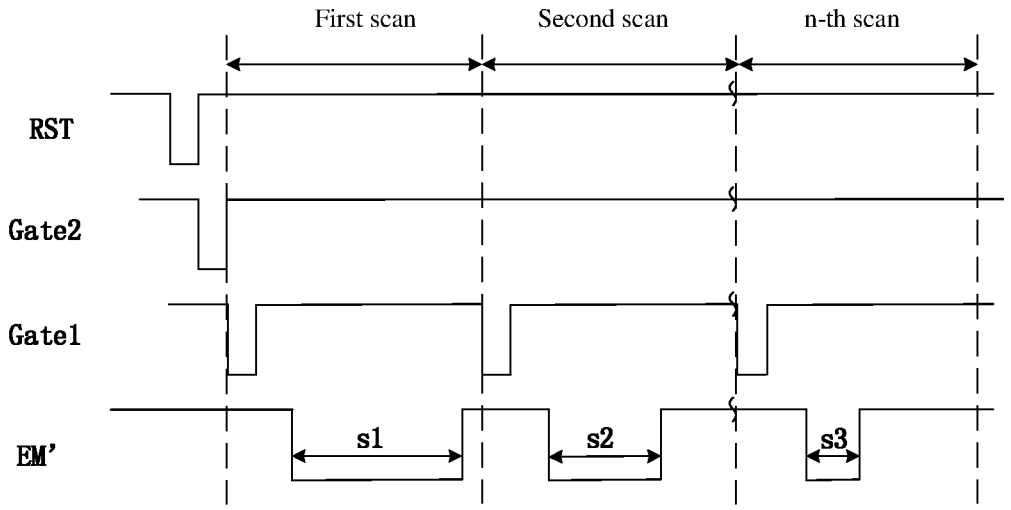
FIG. 1B is a signal timing diagram of a pixel driving circuit.

The pixel driving circuit shown in FIG. 1A is driven by using, for example, the signal timing shown in FIG. 1B. For example, the duration control sub-circuit 02 achieves multi-bit grayscale display by causing a light-emitting control signal EM' to scan multiple times (that is, being at a valid level multiple times) in one frame and using the time data signal Vdata_t (not shown in the figure) to control the ON or OFF of the eighth transistor M8.

For example, the light-emitting control signal EM' is usually generated by a plurality of cascaded shift register units in a gate driving circuit of a display panel, and each shift register unit usually uses, for example, a 10T3C shift register circuit. Since the light-emitting control signal EM' needs to match a gate scanning signal for driving the gate lines and a reset signal for resetting, that is, at least when the gate scanning signal and the reset signal are at an valid level, the light-emitting control signal EM' needs to keep at an invalid level to prevent the light-emitting element from emitting light when it should not emit light. Here, an valid level pulse width of a gate scanning signal in a pixel driving circuit provided in embodiments of the present disclosure, such as a Gate1 signal or a Gate2 signal shown in FIG. 1B, is defined as a unit duration and denoted as H. When the period of two clock signals CK and CB of the same frequency in the shift register circuit outputting the light-emitting control signal EM' is 2H, the valid level pulse width is 0.5H, and the duty radio is 25%, because there are a plurality of cascaded shift registers (the output of the current row is used as the input of the next row), the minimum control duration of the invalid level of the light-emitting control signal EM' for each period is 3H. According to the circuit characteristics of the shift register, the minimum control duration of the invalid level that it can output is equal to the minimum control duration of the valid level that it can output, therefore the minimum control duration of the valid level of the light-emitting control signal EM' for each period is also 3H. By adjusting the duty radio of the input signal or the start trigger signal, it is possible to output a light-emitting control signals EM' with valid level pulse width of different duration. According to the characteristics of the 10T3C shift register circuit, it can be known that the duration of the light-emitting control signal EM' can be 3H+m*2H, where m is an integer greater than or equal to zero. So, it can be known that the interval of the valid level pulse width of the signal that can be realized by the shift register circuit (that is, the minimum unit of increase or decrease) is 2H.

In order to accurately display each gray level, the duration of the valid level of the light-emitting control signal EM' in each time of scan such as s1, s2, s3, etc. needs to be a binary unit duration, that is, $s2=s1/2$, $s3=s1/2^2$, and so on, that is, $si=2*s(i+1)$, i is an integer larger than 0. For example, in one example, the binary unit duration required for the grayscale display and the valid level pulse width output by the shift register circuit are shown in the following table.

TABLE 1

Correspondence between the binary unit duration and the valid level pulse width output by the shift register circuit

| | Number of scan of EM' | | | | |
|---|---|---|---|---|---|
| | First scan | Second scan | Third scan | Fourth scan | Fifth scan |
| Binary unit duration | 48 H | 24 H | 12 H | 6 H | 3 H |
| Valid level pulse width output by the shift register circuit | 3 H + 22 * 2 H | 3 H + 10 * 2 H | 3 H + 4 * 2 H | 3 H + 2 H | 3 H |
| Duration to be compensated | 1 H | 1 H | 1 H | 1 H | |

As can be seen from the above table, when the signal output by the shift register circuit is used as the light-emitting control signal EM', the signal output by the shift register circuit can only approach the binary unit duration and cannot completely match the binary unit duration, which leads to poor gray-scale brightness display of display panels using Micro LED. In order to improve the display quality, it is necessary to compensate the duration of 1 H for the signal output by the shift register circuit, so as to realize the binary unit duration, and then accurately display each gray level.

At least one embodiment of the present disclosure provides a pixel driving circuit, a driving method thereof, and a display panel. The pixel driving circuit can implement binary unit duration control in the case of multiple times of scans, improve the flexibility of the duration control, and thus achieve compensation for grayscale brightness, and improve the display effect of the display panel.

Hereinafter, embodiments of the present disclosure will be described in detail with reference to the accompanying drawings. It should be noted that the same reference numbers in different drawings will be used to refer to the same elements that have been described.

At least one embodiment of the present disclosure provides a pixel driving circuit including a current control circuit and a time control circuit. The current control circuit is configured to receive a display data signal and control a magnitude of a driving current flowing through the current control circuit according to the display data signal. The time control circuit is configured to receive the driving current, and receive a time data signal, a first light-emitting control signal, and a second light-emitting control signal, and control a flowing time period of the driving current according to the time data signal, the first light-emitting control signal, and the second light-emitting control signal.

The pixel driving circuit provided in the above embodiment controls the flowing time of the driving current by comprehensively considering the time data signal, the first light-emitting control signal and the second light-emitting control signal, thereby realizing binary unit duration control in the case of multiple times of scans, improving the flexibility of duration control, thus achieving compensation for grayscale brightness and improving the display effect of the display panel.

Figure 2:
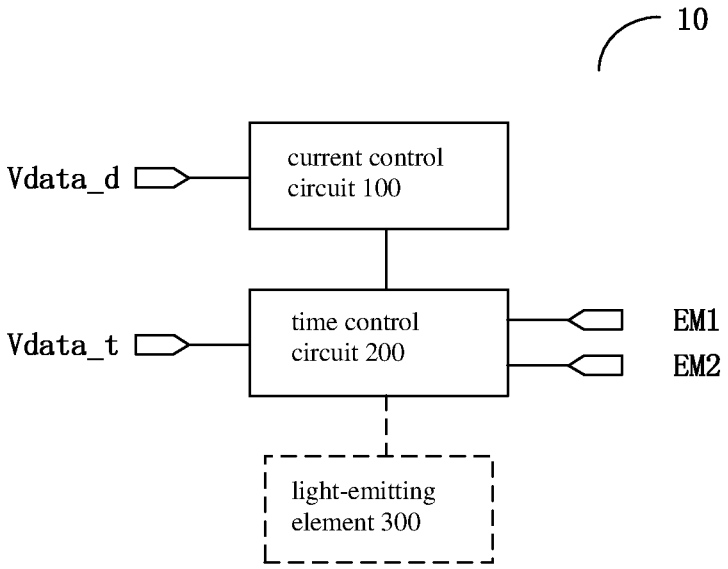
FIG. 2 is a schematic block diagram of a pixel driving circuit provided by some embodiments of the present disclosure.

FIG. 2 is a schematic block diagram of a pixel driving circuit provided by some embodiments of the present disclosure. As shown in FIG. 2, the pixel driving circuit 10 includes a current control circuit 100 and a time control circuit 200. The pixel driving circuit 10 is used for, for example, a sub-pixel or a pixel unit of Micro LED display device. The time control circuit 200 is connected to the light-emitting element 300, for example.

The current control circuit 100 is configured to receive a display data signal and control a magnitude of a driving current flowing through the current control circuit 100 according to the display data signal. For example, the current control circuit 100 is connected to a display data line (display data terminal Vdata_d), a time control circuit 200, and a separately provided high voltage terminal (not shown in the figure), so as to receive the display data signal provided by the display data terminal Vdata_d and the high level signal provided by the high voltage terminal, and provide a driving current to the time control circuit 200. For example, the current control circuit 100 can provide a driving current to the light-emitting element 300 through the time control circuit 200 during operation, so that the light-emitting element 300 can emit light according to the magnitude of the driving current.

The time control circuit 200 is configured to receive the driving current, and receive a time data signal, a first light emission control signal, and a second light-emitting control signal, and control the flowing time period of the drive current according to the time data signal, the first light-emitting control signal, and the second light-emitting control signal. For example, the time control circuit 200 is respectively connected to the time data line (time data terminal Vdata_t), the first light-emitting control line (first light-emitting control terminal EM1), the second light-emitting control line (second light-emitting control terminal EM2), the current control circuit 100 and the light-emitting element 300, so as to receive the time data signal provided by the time data terminal Vdata_t, the first light-emitting control signal provided by the first light-emitting control terminal EM1 and the second light-emitting control signal provided by the second light-emitting control terminal EM2, and provide the driving current from the current control circuit 100 to the light-emitting element 300. For example, the time control circuit 200 can control the flowing time period of the driving current during operation, so that the light-emitting element 300 can receive the driving current and emit light according to the magnitude of the driving current during the corresponding time period, and cannot receive the driving current and do not emit light during other time period. For example, through the cooperation of the first light-emitting control signal, the second light-emitting control signal, and the time data signal, there can be multiple optional values for the flowing time period of the driving current, which further increases the adjustment range of light-emitting time of the light-emitting element 300 to improve the contrast.

The light-emitting element 300 is configured to receive the driving current and emit light according to the magnitude and the flowing time of the driving current. For example, the light-emitting element 300 is connected to the time control circuit 200 and a separately provided low voltage terminal (not shown), so as to receive the driving current from the time control circuit 200 and a low level signal of the low-voltage terminal. For example, when the time control circuit 200 is turned on and provides the driving current from the current control circuit 100 to the light-emitting element 300, the light-emitting element 300 emits light according to the magnitude of the driving current; when the time control circuit 200 is turned off, the light-emitting element 300 does not emit light. For example, the light-emitting element 300 may be a light-emitting diode, such as a Micro LED. In the above operation mode, the light-emitting element 300 is controlled to emit light to achieve the corresponding gray scale according to the magnitude of current and the light-emitting time, which can improve the contrast, make the light-emitting element 300 work in a region with higher light-emitting efficiency under full gray scale, and have less color coordinate drift.

In this embodiment, by using two light-emitting control signals, that is, the first light-emitting control signal and the second light-emitting control signal, the light-emitting time of the light-emitting element 300 can be compensated compared to a case where only one light-emitting control signal is used. For example, the duration that the first light-emitting control signal of the first light-emitting control terminal EM1 can achieve is 3H+m*2H, and the duration that the second light-emitting control signal of the second light-emitting control terminal EM2 can achieve is H. Therefore, through the combined effect of the first light-emitting control signal and the second light-emitting control signal, both the duration of 3H+m*2H and the duration of 3H+m*2H+H can be achieved, thereby realizing the aforementioned binary unit duration (for example, 48H, 24H, 12H, 6H, 3H, etc.). Therefore, the pixel driving circuit 10 can implement binary unit duration control in the case of multiple times of scans, and can improve the flexibility of the duration control, thereby compensating for the gray-scale brightness and improving the display effect of the display panel.

For example, the first light-emitting control signal of the first light-emitting control terminal EM1 and the second light-emitting control signal of the second light-emitting control terminal EM2 are provided by different gate driving circuits, so that the valid level pulse width of the first light-emitting control signal (i.e. with a duration of 3H+m*2H) and the valid level pulse width (i.e. with a duration of H) of the second light-emitting control signal can be adjusted independently, making the adjustment of the valid level pulse width of the second light-emitting control signal more flexible, so as to increase adjustment range of the light-emitting time of the light-emitting element 300, improve the adjustment accuracy of the light-emitting time of the light-emitting element 300, thereby achieving binary unit duration control and compensation for gray-scale brightness.

It should be noted that, in some embodiments of the present disclosure, the current control circuit 100, the time control circuit 200, and the light-emitting element 300 are connected between a separately provided high voltage terminal and a low voltage terminal to provide a current path for the driving current. Therefore, the connection sequence of the current control circuit 100, the time control circuit 200, and the light-emitting element 300 between the high voltage terminal and the low voltage terminal is not limited, and can be any connection sequence, as long as it can provide a current path from the high voltage terminal to the low voltage terminal.

For example, the display data terminal Vdata_d and the time data terminal Vdata_t can be connected to the same signal line and configured to receive the display data signal and the time data signal at different times, thereby reducing the number of signal lines. Certainly, the embodiments of the present disclosure are not limited thereto, the display data terminal Vdata_d and the time data terminal Vdata_t may also be connected to different signal lines, so that the display data signal and the time data signal can be received simultaneously without affecting each other.

Figure 3:
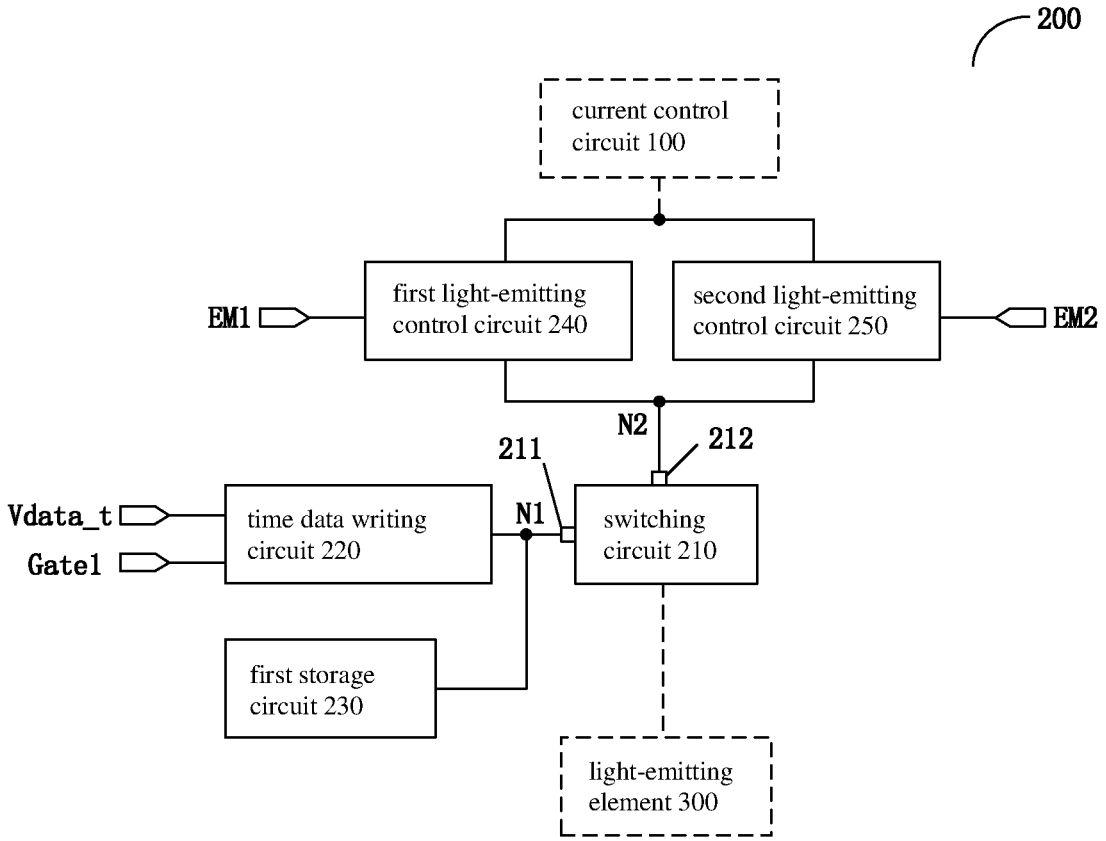
FIG. 3 is a schematic block diagram of a time control circuit of a pixel driving circuit provided by some embodiments of the present disclosure.

FIG. 3 is a schematic block diagram of a time control circuit of a pixel driving circuit provided by some embodiments of the present disclosure. As shown in FIG. 3, the time control circuit 200 includes a switching circuit 210, a time data writing circuit 220, a first storage circuit 230, a first light-emitting control circuit 240, and a second light-emitting control circuit 250.

The switching circuit 210 includes a control terminal 211 and a first terminal 212 and is configured to, in response to the time data signal, be turned on or off so as to allow or not allow the driving current to flow through the switching circuit 210. For example, the switching circuit 210 is connected to a first node N1 and a second node N2, and is also connected to the light-emitting element 300, so as to receive the time data signal written to the first node N1 and to provide the driving current from the second node N2 to the light-emitting element 300. For example, the switching circuit 210 may be turned on or turned off under the control of the time data signal during operation, so as to provide the driving current to the light-emitting element 300 or not to provide the driving current to the light-emitting element 300.

The time data writing circuit 220 is connected to the control terminal 211 of the switching circuit 210, and is configured to write a time data signal to the control terminal 211 of the switching circuit 210 in response to a first scanning signal. For example, the time data writing circuit 220 is connected to the time data line (time data terminal Vdata_t), the first node N1, and a first scanning line (first scanning terminal Gate1), so as to receive the time data signal provided by the time data terminal Vdata_t and the first scanning signal provided by the first scanning terminal Gate1. For example, the time data writing circuit 220 may be turned on in response to the first scanning signal, so that the time data signal may be written to the control terminal 211 (first node N1) of the switching circuit 210, and the time data signal may be stored in the first storage circuit 230.

The first storage circuit 230 is connected to the control terminal 211 of the switching circuit 210, and is configured to store a time data signal written by the time data writing circuit 220. For example, the first storage circuit 230 is connected to the first node N1, and may store the time data signal written to the first node N1 and control the switching circuit 210 with the stored time data signal. For example, the first storage circuit 230 may also be connected to a separately provided voltage terminal (such as a first voltage terminal Vcom described below) to implement a voltage storage function.

The first light-emitting control circuit 240 is connected to the first terminal 212 of the switching circuit 210, and is configured to apply the driving current to the first terminal 212 of the switching circuit 210 in response to a first light-emitting control signal. For example, the first light-emitting control circuit 240 is connected to a first light-emitting control line (the first light-emitting control terminal EM1) and the first terminal 212 (the second node N2) of the switching circuit 210, and is also connected to the current control circuit 100, so as to receive the first light-emitting control signal from the first light-emitting control terminal EM1 and the driving current provided by the current control circuit 100. For example, the first light-emitting control circuit 240 may be turned on in response to the first light-emitting control signal, so that the current control circuit 100 and the second node N2 are electrically connected, and the driving current is applied to the second node N2.

The second light-emitting control circuit 250 is connected in parallel with the first light-emitting control circuit 240 and is therefore also connected to the first terminal 212 of the switching circuit 210, and is configured to apply the driving current to the first terminal 212 of the switching circuit 210 in response to a second light-emitting control signal. For example, the second light-emitting control circuit 250 is connected to a second light-emitting control line (second light-emitting control terminal EM2) and the first terminal 212 (the second node N2) of the switching circuit 210, and is also connected to the current control circuit 100, so as to receive the second light-emitting control signal from the second light-emitting control terminal EM2 and the driving current provided by the current control circuit 100. For example, the second light-emitting control circuit 250 may be turned on in response to the second light-emitting control signal, so that the current control circuit 100 is electrically connected to the second node N2, and the driving current is applied to the second node N2.

For example, the first light-emitting control circuit 240 and the second light-emitting control circuit 250 are respectively turned on at different times, so that the driving current from the current control circuit 100 is applied to the second node N2 at these different times. When the switching circuit 210 is also turned on, the driving current is further applied to the light-emitting element 300 to drive the light-emitting element 300 to emit light. For example, a time period for applying, by the first light-emitting control circuit 240 and the switching circuit 210, the driving current to the light-emitting element 300 to drive the light-emitting element 300 to emit light is a first time period (for example, 0 or 3H+m*2H), and a time period for applying, by the second light-emitting control circuit 250 and the switching circuit 210, the driving current to the light-emitting element 300 to drive the light-emitting element 300 to emit light is a compensation time period (for example, 0 or H), and the light-emitting time of the light-emitting element 300 (that is, the flowing time period described above) is a sum of the first time period and the compensation time period. By this way, the duration of 3H+m*2H or 3H+m*2H+H can be achieved, thereby implementing binary unit duration control.

It should be noted that, in some embodiments of the present disclosure, the time control circuit 200 may include any applicable circuit or module, and is not limited to the above-mentioned switching circuit 210, time data writing circuit 220, first storage circuit 230, and first light-emitting control circuit 240 and second light-emitting control circuit 250 as long as it can achieve corresponding functions.

Figure 4:
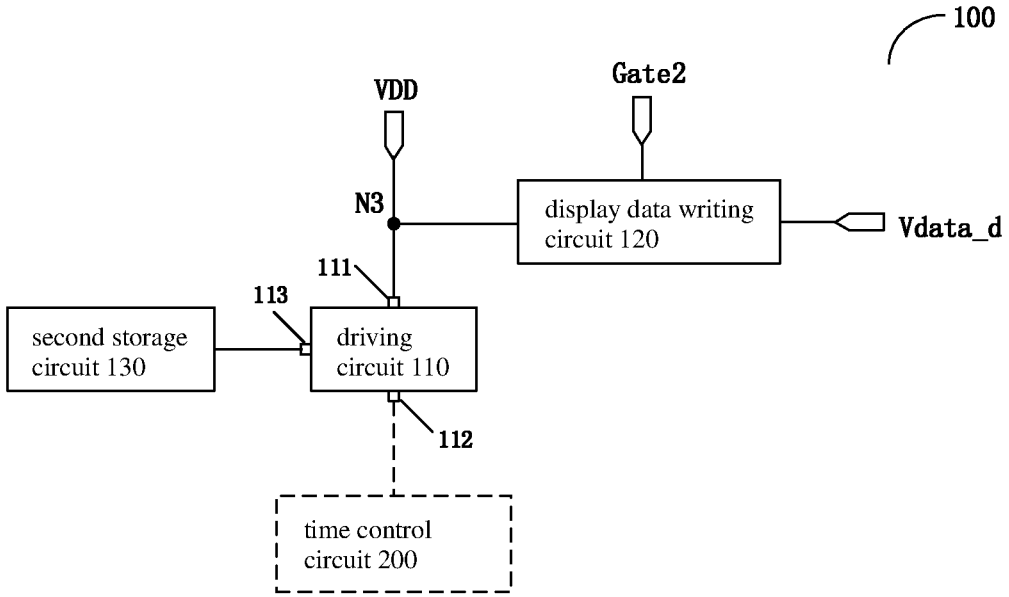
FIG. 4 is a schematic block diagram of a current control circuit of a pixel driving circuit provided by some embodiments of the present disclosure.

FIG. 4 is a schematic block diagram of a current control circuit of a pixel driving circuit provided by some embodiments of the present disclosure. As shown in FIG. 4, the current control circuit 100 includes a driving circuit 110, a display data writing circuit 120, and a second storage circuit 130.

The driving circuit 110 includes a first terminal 111, a second terminal 112, and a control terminal 113, and is configured to control the magnitude of a driving current according to a display data signal. For example, the control terminal 113 of the driving circuit 110 is connected to the second storage circuit 130, the first terminal 111 of the driving circuit 110 is connected to a second voltage terminal VDD, and the second terminal 112 of the driving circuit 110 is connected to the time control circuit 200. For example, the second voltage terminal VDD is configured to input a DC high-level signal continuously, and this DC high level is referred to as a second voltage which is the same in the following embodiments and will not be described again. For example, the driving circuit 110 may provide the driving current to the light-emitting element 300 through the time control circuit 200 (such as the switching circuit 210 and the first light-emitting control circuit 240 or the second light-emitting control circuit 250 of the time control circuit 200), to drive the light-emitting element 300 to emit light, and to drive the light-emitting element 300 to emit light according to a required gray scale (or gray level).

The display data writing circuit 120 is connected to the first terminal 111 of the driving circuit 110 and is configured to write a display data signal to the first terminal 111 of the driving circuit 110 in response to a second scanning signal. For example, the display data writing circuit 120 is connected to a display data line (display data terminal Vdata_d), the first terminal 111 (a third node N3) of the driving circuit 110, and a second scanning line (second scanning terminal Gate2). For example, the second scanning signal from the second scanning terminal Gate2 is applied to the display data writing circuit 120 to control whether the display data writing circuit 120 is turned on. For example, the display data writing circuit 120 may be turned on in response to the second scanning signal, so that the display data signal provided by the display data terminal Vdata_d may be written into the first terminal 111 (the third node N3) of the driving circuit 110, and then the display data signal may be stored in the second storage circuit 130 by the driving circuit 110 to generate a driving current that drives the light-emitting element 300 to emit light according to the display data signal.

It should be noted that, in the embodiments of the present disclosure, the specific connection manner of the display data writing circuit 120 and the driving circuit 110 is not limited. For example, in some embodiments, the display data writing circuit 120 may be connected to the control terminal 113 of the driving circuit 110, so that the display data signal may be written into the control terminal 113 of the driving circuit 110 and stored in the second storage circuit 130.

The second storage circuit 130 is connected to the control terminal 113 of the driving circuit 110 and is configured to store a display data signal written by the display data writing circuit 120. For example, the second storage circuit 130 may store the display data signal and control the driving circuit 110 with the stored display data signal. For example, the second storage circuit 130 may also be connected to the second voltage terminal VDD or a high voltage terminal provided separately to implement a voltage storage function.

Figure 5:
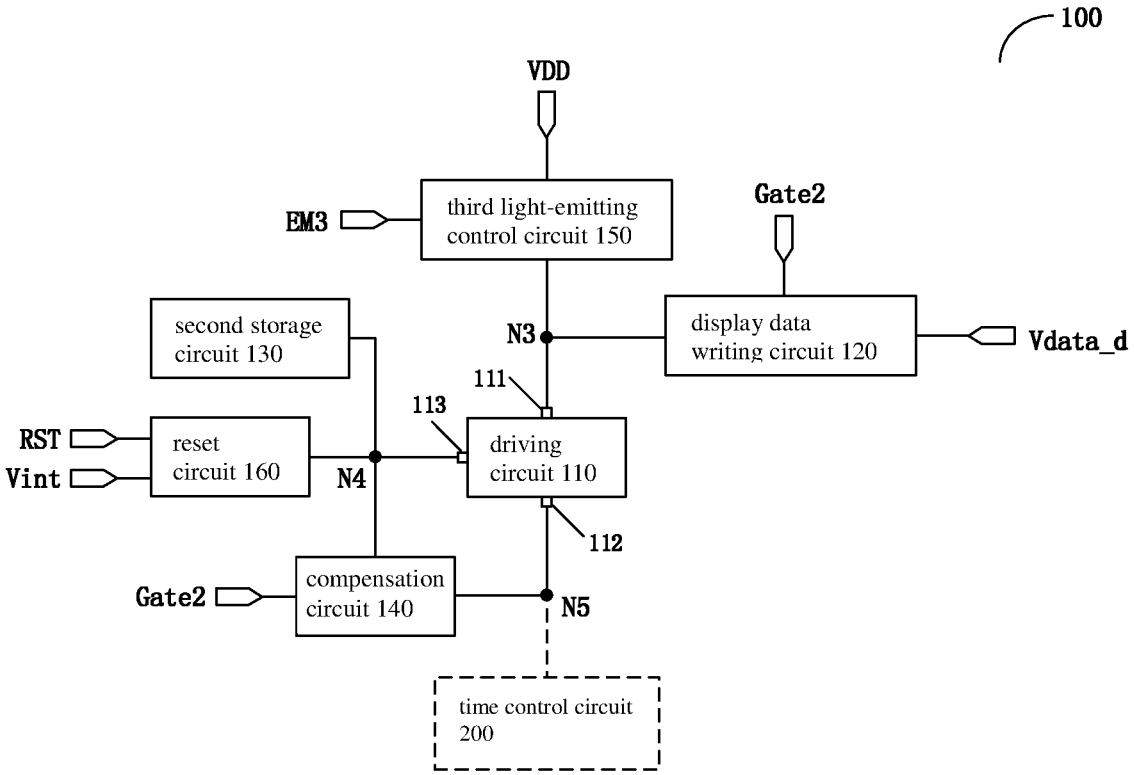
FIG. 5 is a schematic block diagram of a current control circuit of another pixel driving circuit provided by some embodiments of the present disclosure.

FIG. 5 is a schematic block diagram of a current control circuit of another pixel driving circuit provided by some embodiments of the present disclosure. As shown in FIG. 5, the current control circuit 100 may further include a compensation circuit 140, a third light-emitting control circuit 150, and a reset circuit 160. The other structures are basically the same as the current control circuit 100 shown in FIG. 4.

The compensation circuit 140 is connected to the control terminal 113 and the second terminal 112 of the driving circuit 110 and is configured to compensate the driving circuit 110 in response to a second scanning signal and a display data signal written to the first terminal 111 of the driving circuit 110. For example, the compensation circuit 140 is connected to a second scanning line (the second scanning terminal Gate2), a fourth node N4, and a fifth node N5. For example, a second scanning signal from the second scanning terminal Gate2 is applied to the compensation circuit 140 to control whether it is turned on. For example, the compensation circuit 140 may be turned on in response to the second scanning signal, and electrically connect to the control terminal 113 (the fourth node N4) and the second terminal 112 (the fifth node N5) of the driving circuit 110 to store the threshold voltage information of the driving circuit 110 together with the display data signal written by the display data writing circuit 120 in the second storage circuit 130, so that the driving circuit 110 can be controlled by using the stored voltage value including the display data signal and the threshold voltage information to compensate the output of the driving circuit 110.

The third light-emitting control circuit 150 is connected to the first terminal 111 of the driving circuit 110 and is configured to apply a second voltage of the second voltage terminal VDD to the first terminal 111 of the driving circuit 110 in response to a third light-emitting control signal. For example, the third light-emitting control circuit 150 is connected to a third light-emitting control line (a third light-emitting control terminal EM3), the second voltage terminal VDD, and the third node N3. For example, the third light-emitting control circuit 150 may be turned on in response to the third light-emitting control signal provided by the third light-emitting control terminal EM3, so that the second voltage may be applied to the first terminal 111 (third node N3) of the driving circuit 110. When both the driving circuit 110 and the time control circuit 200 are turned on, the driving circuit 110 applies this second voltage to the light-emitting element 300 through the time control circuit 200 to provide a driving voltage, thereby driving the light-emitting element 300 to emit light. It should be noted that the third light-emitting control signal may be the same signal as the first light-emitting control signal to reduce the number of signal lines, or may be an independent signal different from the first light-emitting control signal, and the embodiments of the present disclosure are not limited thereto.

The reset circuit 160 is connected to the control terminal 113 of the driving circuit 110 and is configured to apply a reset voltage of a reset voltage terminal Vint to the control terminal 113 of the driving circuit 110 in response to a reset signal. For example, the reset circuit 160 is connected to the fourth node N4, the reset voltage terminal Vint, and a reset signal line (the reset signal terminal RST). For example, the reset circuit 160 may be turned on in response to the reset signal provided by the reset signal terminal RST, to apply the reset voltage provided by the reset voltage terminal Vint to the control terminal 113 (the fourth node N4) of the driving circuit 110, so that a reset operation may be performed to the driving circuit 110 and the second storage circuit 130 to eliminate the influence of the previous light-emitting period. In addition, the reset voltage applied by the reset circuit 160 can also be stored in the second storage circuit 130, which can maintain the turned on state of the driving circuit 110, so that when the display data signal is written next time, it is convenient for storing the display data signal in the second storage circuit 110 by the driving circuit 110 and the compensation circuit 140.

Figure 6:
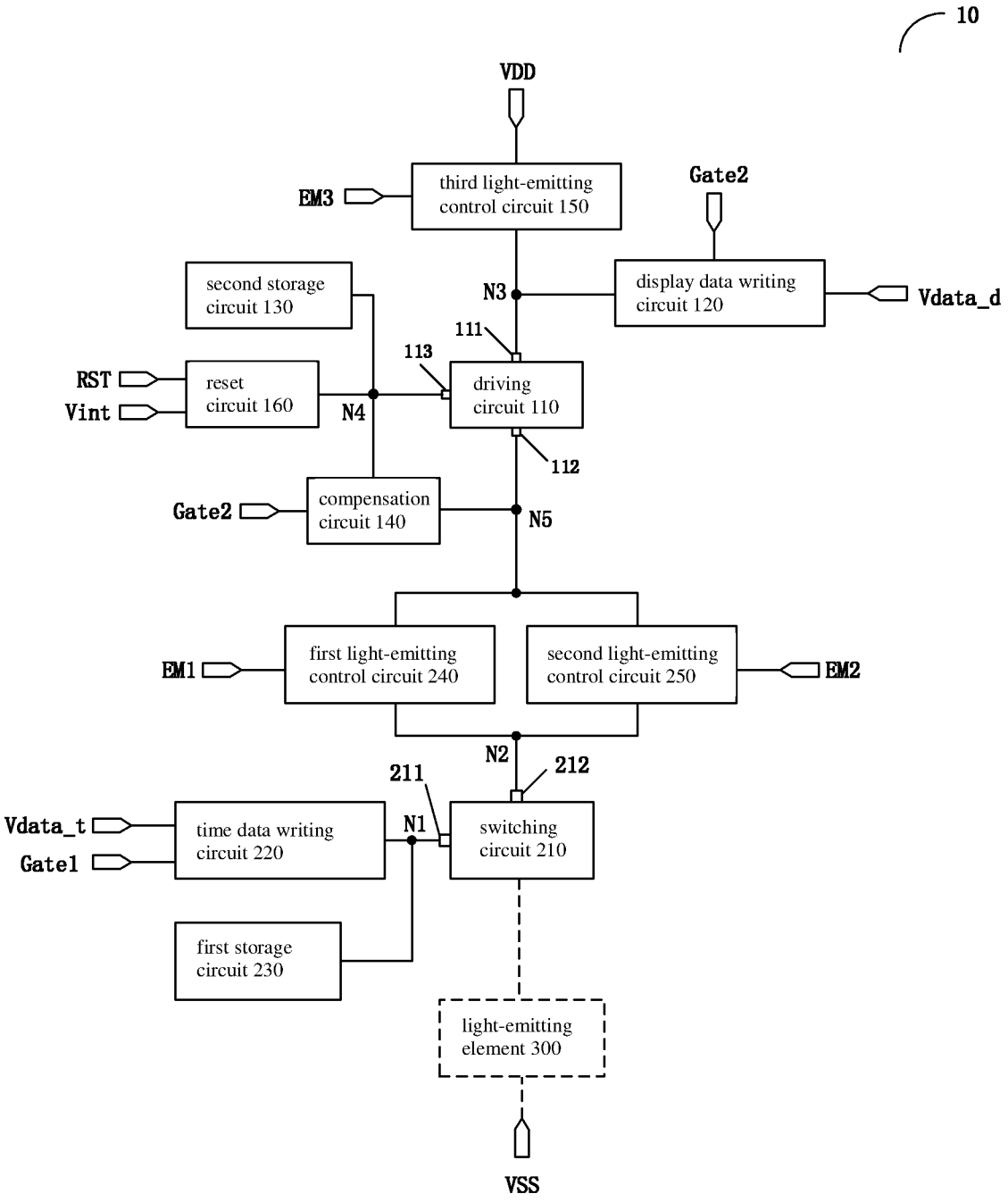
FIG. 6 is a schematic block diagram of another pixel driving circuit provided by some embodiments of the present disclosure.

FIG. 6 is a schematic block diagram of another pixel driving circuit provided by some embodiments of the present disclosure. As shown in FIG. 6, the current control circuit 100 of the pixel driving circuit 10 is basically the same as the current control circuit 100 shown in FIG. 5, and the time control circuit 200 of the pixel driving circuit 10 is basically the same as the time control circuit 200 shown in FIG. 3. For the specific connection relationship and related description of the pixel driving circuit 10, reference may be made to the foregoing content, which is not repeated here. It should be noted that the pixel driving circuit 10 provided by the embodiments of the present disclosure may further include other circuit structures, for example, a circuit structure having other compensation functions. The compensation function may be implemented by voltage compensation, current compensation, or hybrid compensation, and no limitation is made in the embodiments of the present disclosure.

It should be noted that, in some embodiments of the present disclosure, the pixel driving circuit 10 may be obtained by combining the time control circuit 200 with a pixel driving circuit with any other structure which has a function of control the magnitude of the driving current, and is not limited to the above structure, as long as the pixel driving circuit 10 provided by the embodiments of the present disclosure can control the gray scale by jointly using the magnitude of the current and the light-emitting time, and can be controlled by the first light-emitting control signal and the second light-emitting control signal together to achieve a binary unit duration.

Figure 7:
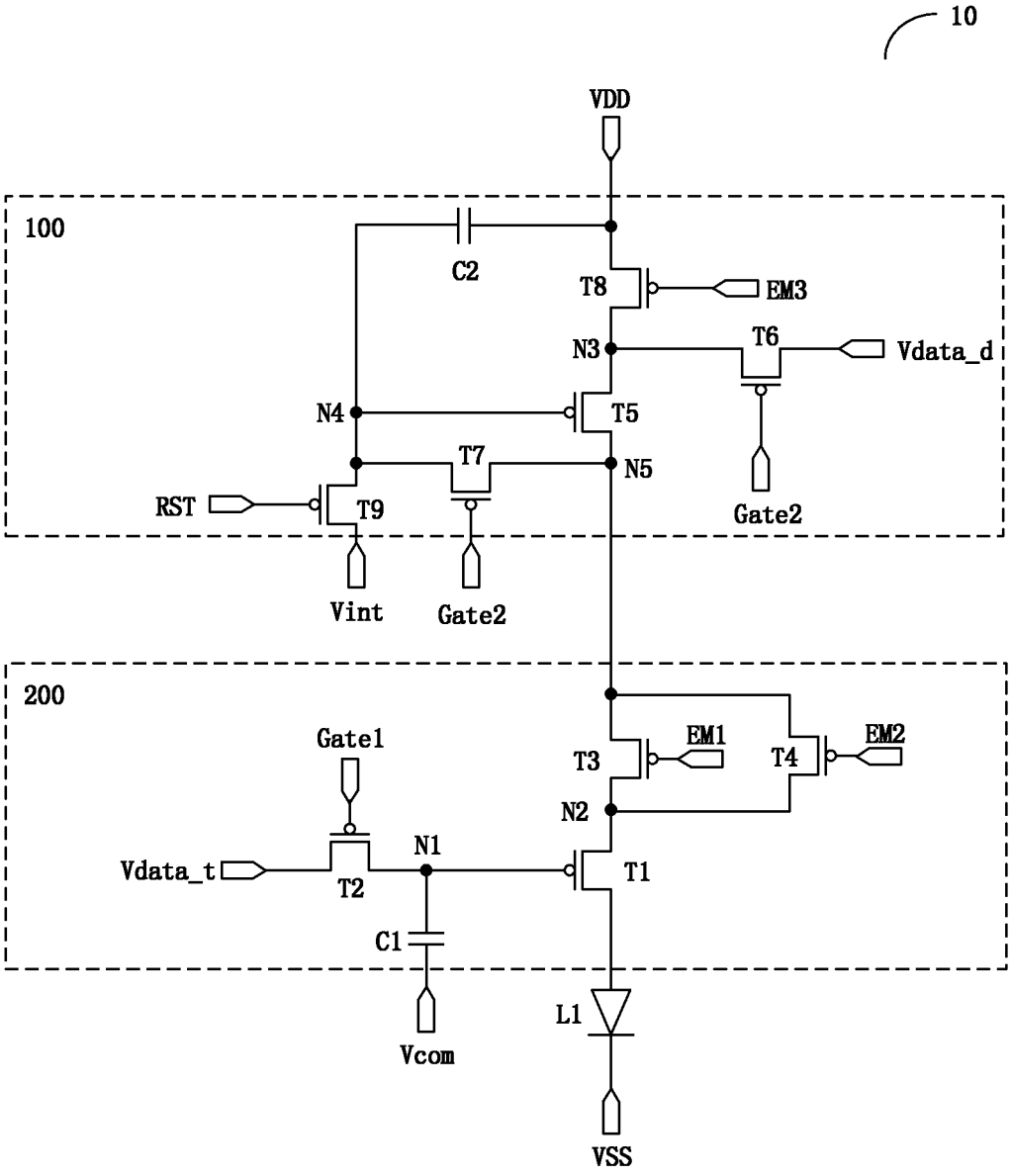
FIG. 7 is a circuit diagram of a specific implementation example of the pixel driving circuit shown in FIG. 6.

FIG. 7 is a circuit diagram of a specific implementation example of the pixel driving circuit shown in FIG. 6. As shown in FIG. 7, the pixel driving circuit 10 includes first to ninth transistors T1-T9 and includes a first capacitor C1 and a second capacitor C2. The pixel driving circuit 10 is also connected to a light-emitting element L1. For example, the fifth transistor T5 is used as a driving transistor, and the other transistors are used as switching transistors. For example, the light-emitting element L1 may be various types of Micro LEDs, and may emit red light, green light, blue light, or white light, which is not limited in the embodiments of the present disclosure.

For example, the switching circuit 210 may be implemented as the first transistor T1. A gate of the first transistor T1 is served as the control terminal 211 of the switching circuit 210 and is connected to the first node N1, a first electrode of the first transistor T1 is served as the first terminal 212 of the switching circuit 210 and is connected to the second node N2, a second electrode of the first transistor T1 is configured to be connected to the light-emitting element L1 (for example, to the anode of the light-emitting element L1). It should be noted that the embodiments of the present disclosure are not limited thereto, and the switching circuit 210 may also be a circuit composed of other components.

The time data writing circuit 220 may be implemented as the second transistor T2. A gate of the second transistor T2 is configured to be connected to the first scanning line (first scanning terminal Gate1) to receive the first scanning signal, a first electrode of the second transistor T2 is configured to be connected to the time data line (time data terminal Vdata_t) to receive the time data signal, and a second electrode of the second transistor T2 is configured to be connected to the control terminal 211 (the first node N1) of the switching circuit 210. It should be noted that the embodiments of the present disclosure are not limited thereto, and the time data writing circuit 220 may also be a circuit composed of other components.

The first storage circuit 230 may be implemented as the first capacitor C1. A first electrode of the first capacitor C1 is configured to be connected to the control terminal 211 (first node N1) of the switching circuit 210, and a second electrode of the first capacitor C1 is configured to be connected to the first voltage terminal Vcom to receive the first voltage. For example, the first voltage terminal Vcom is configured to input a DC low-level signal constantly, such as being connected to ground. This DC low-level is referred to as a first voltage, which is the same in the following embodiments and will not be described again. It should be noted that the embodiments of the present disclosure are not limited thereto, and the first storage circuit 230 may also be a circuit composed of other components.

The first light-emitting control circuit 240 may be implemented as the third transistor T3. A gate of the third transistor T3 is configured to be connected to the first light-emitting control line (the first light-emitting control terminal EM1), a first electrode of the third transistor T3 is configured to be connected to the current control circuit 100 to receive the driving current, and a second electrode of the third transistor T3 is connected to the first terminal 212 (second node N2) of the switching circuit 210. It should be noted that the embodiments of the present disclosure are not limited thereto, and the first light-emitting control circuit 240 may also be a circuit composed of other components.

The second light-emitting control circuit 250 may be implemented as the fourth transistor T4. A gate of the fourth transistor T4 is configured to be connected to the second light-emitting control line (the second light-emitting control terminal EM2), a first electrode of the fourth transistor T4 is configured to be connected to the current control circuit 100 to receive the driving current, and a second electrode of the fourth transistor T4 is configured to be connected to the first terminal 212 (the second node N2) of the switching circuit 210. It should be noted that the embodiments of the present disclosure are not limited thereto, and the second light-emitting control circuit 250 may also be a circuit composed of other components.

The driving circuit 110 may be implemented as the fifth transistor T5. A gate of the fifth transistor T5 is served as the control terminal 113 of the driving circuit 110 and is connected to the fourth node N4, a first electrode of the fifth transistor T5 is served as the first terminal 111 of the driving circuit 110 and is connected to the third node N3, and a second electrode of the fifth transistor T5 is served as the second terminal 112 of the driving circuit 110 and is connected to the fifth node N5, and is configured to be connected to the time control circuit 200 (for example, to the first electrode of the third transistor T3 and the first electrode of the fourth transistor T4). It should be noted that the embodiments of the present disclosure are not limited thereto. The driving circuit 110 may also be a circuit composed of other components. For example, the driving circuit 110 may have two sets of driving transistors, and the two sets of driving transistors may be switched according to specific conditions.

The display data writing circuit 120 may be implemented as the sixth transistor T6. A gate of the sixth transistor T6 is configured to be connected to the second scanning line (the second scanning terminal Gate2) to receive the second scanning signal, a first electrode of the sixth transistor T6 is configured to be connected to the display data line (the display data terminal Vdata_d) to receive the display data signal, and a second electrode of the sixth transistor T6 is configured to be connected to the first terminal 111 (the third node N3) of the driving circuit 110. It should be noted that, in the embodiments of the present disclosure, the connection relationship of the sixth transistor T6 and the fifth transistor T5 is not limited. For example, in other embodiments without the compensation circuit 140, the second electrode of the sixth transistor T6 may be connected to the gate of the fifth transistor T5 to write a display data signal to the gate of the fifth transistor T5. The display data writing circuit 120 may be a circuit composed of other components, which is not limited in the embodiment of the present disclosure.

The second storage circuit 130 may be implemented as the second capacitor C2. A first electrode of the second capacitor C2 is configured to be connected to the control terminal 113 (the fourth node N4) of the driving circuit 110, and a second electrode of the second capacitor C2 is configured to be connected to the second voltage terminal VDD to receive the second voltage. It should be noted that the embodiments of the present disclosure are not limited thereto, and the second storage circuit 130 may also be a circuit composed of other components. For example, the second storage circuit 130 may include two capacitors connected in parallel/series with each other.

The compensation circuit 140 may be implemented as the seventh transistor T7. A gate of the seventh transistor T7 is configured to be connected to the second scanning line (the second scanning terminal Gate2) to receive the second scanning signal, a first electrode of the seventh transistor T7 is configured to be connected to the control terminal 113 (the fourth node N4) of the driving circuit 110, and a second electrode of the seventh transistor T7 is configured to be connected to the second terminal 112 (the fifth node N5) of the driving circuit 110. It should be noted that the embodiments of the present disclosure are not limited thereto, and the compensation circuit 140 may be a circuit composed of other components.

The third light-emitting control circuit 150 may be implemented as the eighth transistor T8. A gate of the eighth transistor T8 is configured to be connected to the third light-emitting control line (the third light-emitting control terminal EM3) to receive the third light-emitting control signal, a first electrode of the eighth transistor T8 is configured to be connected to the second voltage terminal VDD, and a second electrode of the eighth transistor T8 is configured to be connected to the first terminal 111 (the third node N3) of the driving circuit 110. It should be noted that the embodiments of the present disclosure are not limited thereto, and the third light-emitting control circuit 150 may be a circuit composed of other components.

The reset circuit 160 may be implemented as the ninth transistor T9. A gate of the ninth transistor T9 is configured to be connected to the reset signal line (the reset signal terminal RST) to receive the reset signal, a first electrode of the ninth transistor T9 is configured to be connected to the control terminal 113 (the fourth node N4) of the driving circuit 110, and a second electrode of the ninth transistor T9 is configured to be connected to the reset voltage terminal Vint to receive the reset voltage. It should be noted that the embodiments of the present disclosure are not limited thereto, and the reset circuit 160 may also be a circuit composed of other components.

The light-emitting element 300 may be implemented as the light-emitting element L1 (for example, a Micro LED). A first terminal (here, the anode) of the light-emitting element L1 is connected to the second electrode of the first transistor T1, and a second terminal (here, the cathode) of the light-emitting element L1 is connected to a third voltage terminal VSS to receive a third voltage. For example, the third voltage terminal VSS is configured to input a DC low-level signal constantly, such as being connected to ground. This DC low-level is referred to as the third voltage which is the same in the following embodiments and will not be described again. For example, in some embodiments, the third voltage terminal VSS may be connected to the same voltage terminal as the first voltage terminal Vcom. For example, in a display panel, when the pixel driving circuits 10 are arranged in an array, the cathodes of the light-emitting elements L1 may be electrically connected to the same voltage terminal, that is, a common cathode connection method is adopted.

For example, in this embodiment, the third transistor T3 and the fourth transistor T4 are connected in parallel between the fifth node N5 and the second node N2, so that the driving current can flow through any one of the third transistor T3 and the fourth transistor T4 to be transmitted between the fifth node N5 and the second node N2. For example, the eighth transistor T8, the fifth transistor T5, the first transistor T1, the light-emitting element L1 are connected to any one of the third transistor T3 and the fourth transistor T4, and are connected between the second voltage terminal VDD and the third voltage terminal VSS, to provide a current path of the driving current, and the light-emitting element L1 emits light under the driving of the driving current. It should be noted that in some embodiments of the present disclosure, the connection order of the eighth transistor T8, the fifth transistor T5, the first transistor T1, the light-emitting element L1, the third transistor T3, and the fourth transistor T4 is not limited by the situation shown in the figure, and it can be any appropriate connection order, as long as the current path of the driving current can be provided, and the third transistor T3 and the fourth transistor T4 can be connected in parallel in the current path.

Figure 8:
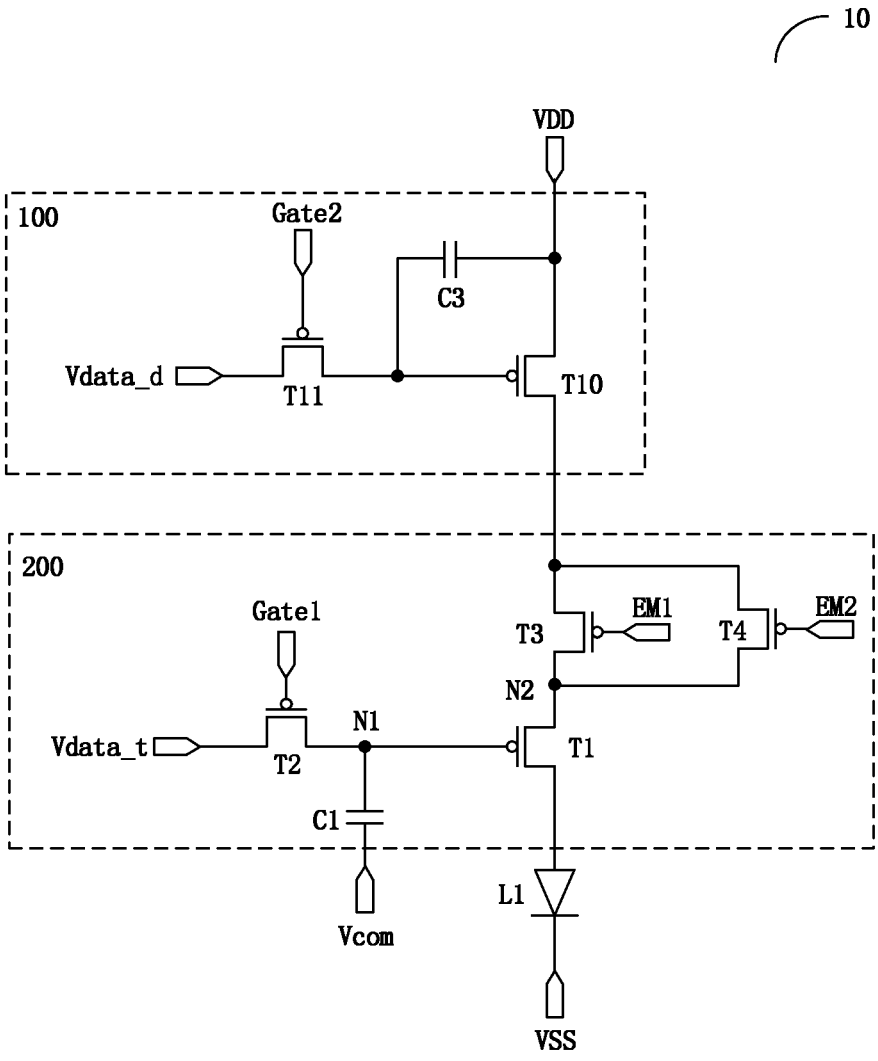
FIG. 8 is a circuit diagram of a specific implementation example of the pixel driving circuit shown in FIG. 2.

FIG. 8 is a circuit diagram of a specific implementation example of the pixel driving circuit shown in FIG. 2. As shown in FIG. 8, the pixel driving circuit 10 includes first to fourth transistors T1-T4, a tenth transistor T10, an eleventh transistor T11, a first capacitor C1 and a third capacitor C3. The pixel driving circuit 10 is also connected to a light-emitting element L1. The connection manners of the first to fourth transistors T1-T4, the first capacitor C1, and the light-emitting element L1 are basically the same as those of the pixel driving circuit 10 shown in FIG. 7 and will not repeated here.

In this embodiment, the current control circuit 100 includes only the driving circuit 110, the display data writing circuit 120, and the second storage circuit 130. And the current control circuit 100 can be implemented as a basic 2T1C circuit. For example, as shown in FIG. 8, the driving circuit 110 may be implemented as the tenth transistor T10. A gate of the tenth transistor T10 is configured to be connected to the display data writing circuit 120, a first electrode of the tenth transistor T10 is configured to be connected to the second voltage terminal VDD, and a second electrode of the tenth transistor T10 is configured to be connected to the first electrode of the third transistor T3. The display data writing circuit 120 may be implemented as the eleventh transistor T11. A gate of the eleventh transistor T11 is configured to be connected to the second scanning line (the second scanning terminal Gate2) to receive the second scanning signal, a first electrode of the eleventh transistor T11 is configured to be connected to the display data line (the display data terminal Vdata_d) to receive the display data signal, and a second electrode of the eleventh transistor T11 is configured to be connected to the gate of the tenth transistor T10. The second storage circuit 130 may be implemented as the third capacitor C3. A first electrode of the third capacitor C3 is configured to be connected to the gate of the tenth transistor T10, and a second electrode of the third capacitor C3 is configured to be connected to the second voltage terminal VDD.

It should be noted that, in some embodiments of the present disclosure, the current control circuit 100 in the pixel driving circuit 10 may be implemented as a pixel driving circuit of any structure, such as 2T1C, 4T1C, 4T2C, and the like. Accordingly, the connection order of the transistors (for example, the first transistor T1, the third transistor T3, and the fourth transistor T4) in the time control circuit 200 that provide a current path for the driving current, and the driving transistor in the above-mentioned 2T1C, 4T1C, 4T2C and other circuits is not limited, for example, in other embodiments, the tenth transistor T10 may also be connected between the first transistor T1 and the light-emitting element L1.

It should be noted that, in the description of each embodiment of the present disclosure, the first node N1, the second node N2, the third node N3, the fourth node N4, and the fifth node N5 do not represent actual components, but rather represent conjunction points of related electrical connections in a circuit diagram.

It should be noted that the transistors used in the embodiments of the present disclosure may all be thin film transistors, field effect transistors, or other switching devices with the same characteristics. In the embodiments of the present disclosure, the thin film transistors are used as examples for description. The source and drain of the transistor used here can be symmetrical in structure, so there can be no difference in structure of the source and drain of the transistor. In the embodiments of the present disclosure, in order to distinguish the two electrodes of the transistor except the gate, one electrode is directly described as the first electrode and the other electrode is described as the second electrode.

In addition, the transistors in the embodiments of the present disclosure are described by taking P-type transistor as an example. In this case, the first electrode of the transistor is a source and the second electrode is a drain. It should be noted that the present disclosure includes but is not limited to this. For example, one or more transistors in the pixel driving circuit 10 provided by the embodiments of the present disclosure may also be N-type transistors. In this case, the first electrode of the transistor is a drain and the second electrode is a source, as long as the polarities of the respective electrodes of the selected type of transistors are correspondingly connected according to the polarities of the respective electrodes of the respective transistors in the embodiments of the present disclosure, and the respective voltage terminals provide corresponding high voltages or low voltages. In a case where N-type transistors are used, Indium Gallium Zinc Oxide (IGZO) can be used as the active layer of the thin film transistor, and compared with cases where low temperature polysilicon (LTPS) or amorphous silicon (such as hydrogenated amorphous silicon) is used as the active layer of the thin film transistor, the size of the transistor can be effectively reduced and leakage current can be prevented. When P-type transistors are used, low temperature polysilicon (LTPS) or amorphous silicon (such as hydrogenated amorphous silicon) can be used as the active layer of the thin film transistor.

Figure 9:
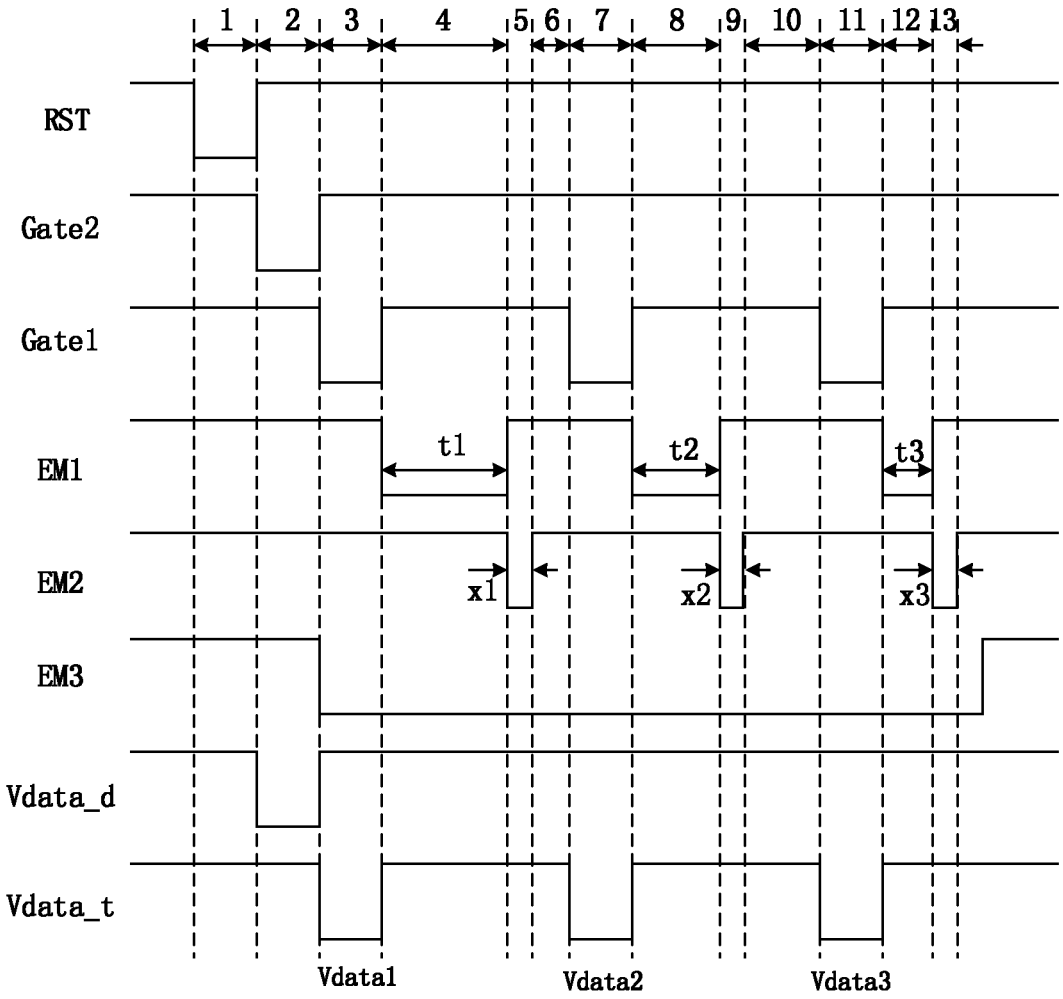
FIG. 9 is a signal timing diagram of a pixel driving circuit provided by some embodiments of the present disclosure.

FIG. 9 is a signal timing diagram of a pixel driving circuit provided by some embodiments of the present disclosure. The operation principle of the pixel driving circuit 10 shown in FIG. 7 will be described below with reference to the signal timing diagram shown in FIG. 9. In addition, it is described here by taking that each transistor is a P-type transistor as an example, that is, the gate of each transistor is turned on when the low level is connected, and turned off when the high level is connected, but the embodiments of the present disclosure is not limited thereto.

In FIG. 9 and the following description, RST, Gate1, Gate2, EM1, EM2, EM3, Vdata_d, Vdata_t, etc. are used to represent both the corresponding signal terminal and the corresponding signal. In the first to thirteenth periods 1-13 shown in FIG. 9, the pixel driving circuit 10 can perform the following operations, respectively.

At the first period 1, the reset signal terminal RST provides a low-level signal, the ninth transistor T9 is turned on, and a low-level signal (not shown in the figure) of the reset voltage terminal Vint is input to the fourth node N4. The gate of the fifth transistor T5 and the second capacitor C2 are reset by the low level of the fourth node N4. In addition, the fifth transistor T5 is turned on by the low level of the fourth node N4 and is maintained to the next period, so that the display data signal is written at the next period.

At the second period 2, the second scanning terminal Gate2 and the display data terminal Vdata_d each provides a low-level signal and the sixth transistor T6 and the seventh transistor T7 are both turned on. The fifth transistor T5 remains to be turned on. Therefore, the display data signal provided by the display data terminal Vdata_d is written to the fourth node N4 through a path formed by the sixth transistor T6, the fifth transistor T5, and the seventh transistor T7 and stored by the second capacitor C2. It is easy to understand that the potential of the third node N3 is kept at Vdata_d, and according to the characteristics of the fifth transistor T5, when the potential of the fourth node N4 becomes Vdata_d+Vth, the fifth transistor T5 is turned off and the charging process ends. Here, Vth represents the threshold voltage of the fifth transistor T5. Since the fifth transistor T5 is described by taking a P-type transistor as an example in this embodiment, the threshold voltage Vth may be a negative value here. Since the potential of the fourth node N4 is Vdata_d+Vth, the related information including the display data signal Vdata_d and the threshold voltage Vth is stored in the second capacitor C2, which is used to provide display data and compensate the threshold voltage Vth of the transistor T5 itself in the subsequent light-emitting period.

At the third period 3, the third light-emitting control terminal EM3 provides a low-level signal, and the eighth transistor T8 is turned on. Since the potential of the fourth node N4 is Vdata_d+Vth and the potential of the third node N3 is VDD, the fifth transistor T5 is turned on. The first scanning terminal Gate1 and the time data terminal Vdata_t provide low-level signals, the second transistor T2 is turned on, and the time data signal provided by the time data terminal Vdata_t is written into the first node N1 and stored by the first capacitor C1. The first transistor T1 is turned on by the low level of the first node N1. The first light-emitting control terminal EM1 and the second light-emitting control terminal EM2 provide high-level signals, so the third transistor T3 and the fourth transistor T4 are both turned off, and the light-emitting element L1 does not emit light at this period. It should be noted that, in another example, the time data terminal Vdata_t can also provide a high-level signal at this time, and the first transistor T1 will be turned off accordingly.

At the fourth period 4, the eighth transistor T8, the fifth transistor T5, and the first transistor T1 remain to be turned on. The first light-emitting control terminal EM1 provides a low-level signal, and the third transistor T3 is turned on. The second voltage terminal VDD, the eighth transistor T8, the fifth transistor T5, the third transistor T3, the first transistor T1, the light-emitting element L1, and the third voltage terminal VSS form a current path. Therefore, the light-emitting element L1 is driven to emit light by the driving current. At this time, the magnitude of the driving current is determined according to the display data signal Vdata_d written at the second period 2, and whether or not to emit light is determined by the time data signal Vdata_t written at the third period 3. And in the case of emitting light, the light-emitting time is equal to the valid level pulse width t1 of the first light-emitting control signal EM1 at this period. It should be noted that, in other embodiments, if a high-level signal is provided by the time data terminal Vdata_t at the third period 3, the first transistor T1 will remain to be turned off, and the light-emitting element L1 will not emit light at this period.

For example, the value of the driving current $I_{L1}$ flowing through the light-emitting element L1 can be obtained according to the following formula:

$$\begin{aligned} I_{L1} &= K(V_{GS} - Vth)^2 \\ &= K[(\text{Vdata_d} + Vth - VDD) - Vth]^2 \\ &= K(\text{Vdata_d} + VDD)^2 \end{aligned}$$

In the above formula, Vth represents the threshold voltage of the fifth transistor T5, $V_{GS}$ represents the voltage between the gate and source (here, the first electrode) of the fifth transistor T5, and K is a constant value related to the fifth transistor T5 itself. It can be seen from the above formula that the driving current $I_{L1}$ flowing through the light-emitting element L1 is no longer related to the threshold voltage Vth of the fifth transistor T5, so that compensation for the pixel driving circuit 10 can be realized, the problem of threshold voltage drift of the driving transistor (such as the fifth Transistor T5) caused by the manufacturing process and long-term operation is solved, and its influence on the driving current $I_{L1}$ is thus eliminated, so that the display effect of the display device using the pixel driving circuit 10 can be improved.

At the fifth period 5, the eighth transistor T8, the fifth transistor T5, and the first transistor T1 remain to be turned on. The second light-emitting control terminal EM2 provides a low-level signal and the fourth transistor T4 is turned on. The second voltage terminal VDD, the eighth transistor T8, the fifth transistor T5, the fourth transistor T4, the first transistor T1, the light-emitting element L1, and the third voltage terminal VSS form a current path. Therefore, the light-emitting element L1 is driven to emit light continually by the driving current. At this time, the magnitude of the driving current is determined according to the display data signal Vdata_d written at the second period 2, that is, the magnitude is the same as the magnitude of the driving current at the fourth period 4. Whether or not to emit light is determined by the time data signal Vdata_t written at the third period 3. And in the case of emitting light, the light-emitting time is equal to the valid level pulse width x1 of the second light-emitting control signal EM2 at this period. It should be noted that, in other embodiments, if a high-level signal is provided by the time data terminal Vdata_t at the third period 3, the first transistor T1 will remain to be turned off, and the light-emitting element L1 will not emit light at this period.

At the sixth period 6, the first light-emitting control terminal EM1 and the second light-emitting control terminal EM2 each provides a high-level signal, and the third transistor T3 and the fourth transistor T4 are both turned off.

Therefore, the current path of the driving current is disconnected, and the light-emitting element L1 does not emit light.

At the seventh period 7, the eighth transistor T8 and the fifth transistor T5 remain to be turned on. The first scanning terminal Gate1 and the time data terminal Vdata_t each provides a low-level signal, the second transistor T2 is turned on, and the time data signal provided by the time data terminal Vdata_t is written into the first node N1 and stored by the first capacitor C1. The first transistor T1 is turned on by the low level of the first node N1. The first light-emitting control terminal EM1 and the second light-emitting control terminal EM2 each provides a high-level signal and the third transistor T3 and the fourth transistor T4 are both turned off, and the light-emitting element L1 does not emit light at this period. It should be noted that, in other embodiments, the time data terminal Vdata_t can also provide a high-level signal at this time, and the first transistor T1 will be turned off accordingly.

At the eighth period 8, the eighth transistor T8, the fifth transistor T5, and the first transistor T1 remain to be turned on. The first light-emitting control terminal EM1 provides a low-level signal and the third transistor T3 is turned on. The second voltage terminal VDD, the eighth transistor T8, the fifth transistor T5, the third transistor T3, the first transistor T1, the light-emitting element L1, and the third voltage terminal VSS form a current path. Therefore, the light-emitting element L1 is driven to emit light by the driving current. At this time, the magnitude of the driving current is still determined according to the display data signal Vdata_d written at the second period 2, and whether or not to emit light is determined by the time data signal Vdata_t written at the seventh period 7. In the case of emitting light, the light-emitting time is equal to the valid level pulse width t2 of the first light-emitting control signal EM1 at this period. It should be noted that, in other embodiments, if a high-level signal is provided by the time data terminal Vdata_t at the seventh period 7, the first transistor T1 will remain to be turned off, and the light-emitting element L1 will not emit light at this period.

At the ninth period 9, the eighth transistor T8, the fifth transistor T5, and the first transistor T1 remain to be turned on. The second light-emitting control terminal EM2 provides a low-level signal and the fourth transistor T4 is turned on. The second voltage terminal VDD, the eighth transistor T8, the fifth transistor T5, the fourth transistor T4, the first transistor T1, the light-emitting element L1, and the third voltage terminal VSS form a current path. Therefore, the light-emitting element L1 is driven to emit light continually by the driving current. At this time, the magnitude of the driving current is still determined according to the display data signal Vdata_d written at the second period 2, whether or not to emit light is determined by the time data signal Vdata_t written at the seventh period 7. And in the case of emitting light, the light-emitting time is equal to the valid level pulse width x2 of the second light-emitting control signal EM2 at this period. It should be noted that, in other embodiments, if a high-level signal is provided by the time data terminal Vdata_t at the seventh period 7, the first transistor T1 will remain to be turned off, and the light-emitting element L1 will not emit light at this period.

At the tenth period 10, the first light-emitting control terminal EM1 and the second light-emitting control terminal EM2 each provides a high-level signal, and the third transistor T3 and the fourth transistor T4 are both turned off. Therefore, the current path of the driving current is disconnected, and the light-emitting element L1 does not emit light.

At the eleventh period 11, the eighth transistor T8 and the fifth transistor T5 remain to be turned on. The first scanning terminal Gate1 and the time data terminal Vdata_t each provides a low-level signal, the second transistor T2 is turned on, and the time data signal provided by the time data terminal Vdata_t is written into the first node N1 and stored by the first capacitor C1. The first transistor T1 is turned on by the low level of the first node N1. The first light-emitting control terminal EM1 and the second light-emitting control terminal EM2 each provides a high-level signal, the third transistor T3 and the fourth transistor T4 are both turned off, and the light-emitting element L1 does not emit light at this period. It should be noted that, in other embodiments, the time data terminal Vdata_t can also provide a high-level signal at this time, and the first transistor T1 will be turned off accordingly.

At the twelfth period 12, the eighth transistor T8, the fifth transistor T5, and the first transistor T1 remain to be turned on. The first light-emitting control terminal EM1 provides a low-level signal, and the third transistor T3 is turned on. The second voltage terminal VDD, the eighth transistor T8, the fifth transistor T5, the third transistor T3, the first transistor T1, the light-emitting element L1, and the third voltage terminal VSS form a current path. Therefore, the light-emitting element L1 is driven to emit light by the driving current. At this time, the magnitude of the driving current is still determined according to the display data signal Vdata_d written at the second period 2, whether or not to emit light is determined by the time data signal Vdata_t written at the eleventh period 11. And in the case of emitting light, the light-emitting time is equal to the valid level pulse width t3 of the first light-emitting control signal EM1 at this period. It should be noted that, in other embodiments, if a high-level signal is provided by the time data terminal Vdata_t at the eleventh period 11, the first transistor T1 will remain to be turned off, and the light-emitting element L1 will not emit light at this period.

At the thirteenth period 13, the eighth transistor T8, the fifth transistor T5, and the first transistor T1 remain to be turned on. The second light-emitting control terminal EM2 provides a low-level signal and the fourth transistor T4 is turned on. The second voltage terminal VDD, the eighth transistor T8, the fifth transistor T5, the fourth transistor T4, the first transistor T1, the light-emitting element L1, and the third voltage terminal VSS form a current path. Therefore, the light-emitting element L1 is driven to emit light continually by the driving current. At this time, the magnitude of the driving current is still determined according to the display data signal Vdata_d written at the second period 2, whether or not to emit light is determined by the time data signal Vdata_t written at the eleventh period 11. And in the case of emitting light, the light-emitting time is equal to the valid level pulse width x3 of the second light-emitting control signal EM2 at this period. It should be noted that, in other embodiments, if a high-level signal is provided by the time data terminal Vdata_t at the eleventh period 11, the first transistor T1 will remain to be turned off, and the light-emitting element L1 will not emit light at this period.

For example, during the display process, each frame of picture is formed by superimposing any one or more pictures displayed during the fourth period 4 (t1 period), the fifth period 5 (x1 period), the eighth period 8 (t2 period), the ninth period 9 (x2 period), the twelfth period 12 (t3 period), and the thirteenth period 13 (x3 period). For example, for each frame of picture, the pixel driving circuit 10 performs multiple scans to write the time data signal Vdata_t multiple times, and the light-emitting time corresponding to the multiple scans is t1+x1, t2+x2, and t3+x3, respectively. For example, the duration of t1+x1, t2+x2, and t3+x3 are different from each other, and t1+x1, t2+x2, and t3+x3 may be the binary unit duration described above. For example, in one example, t1+x1=48H, t2+x2=24H, and t3+x3=12H. t1, t2, and t3 may be, for example, the duration 3H+m*2H described above, and t1, t2, and t3 are different from each other. x1, x2, x3 may be, for example, the duration H described above, and the three are the same as each other, for example. In the above embodiment, on the basis of the first light-emitting control signal EM1 controlling the light-emitting time t1, t2, t3, the light-emitting time x1, x2, x3 is controlled by the second light-emitting control signal EM2 to compensate the difference between t1, t2, t3 and the binary unit duration, thereby realizing the compensation of the grayscale brightness, so that the binary unit duration control can be realized in the case of multiple scans, the flexibility of the duration control is improved, and the display effect of the display panel is improved.

In addition, in the above embodiment, the t1 period and the x1 period are continuous with each other and do not overlap, however, the t1 period and the x1 period may be continuous and partially overlap with each other in some embodiments, or the t1 period and the x1 period may be discontinuities with each other in some embodiments, as long as the total length of t1+x1 in the time domain meets the requirements, such as t1+x1=48H as described above. Similarly, the t2 period and the x2 period are continuous with each other and do not overlap, however, the t2 period and the x2 period may be continuous and partially overlap with each other in some embodiments, or the t2 period and the x2 period may be discontinuous with each other in some embodiments, as long as the total length of t2+x2 in the time domain meets the requirements, for example, t2+x2=24H as described above. Similarly, the t3 period and the x3 period are continuous with each other and do not overlap, however, the t3 period and the x3 period may be continuous with each other and partially overlap in some embodiments, or the t3 period and the x3 period may be discontinuous with each other in some embodiments, as long as the total length of t3+x3 in the time domain meets the requirements, for example, t3+x3=12H as described above.

For example, the time data signal Vdata_t written at the third period 3 is Vdata1, the time data signal Vdata_t written at the seventh period 7 is Vdata2, and the time data signal Vdata_t written at the eleventh period 11 is Vdata3. The three time data signals Vdata1, Vdata2, and Vdata3 can be respectively set to a high level or a low level as required (that is, they can be set to logic "1" or logic "0", respectively). When Vdata1, Vdata2, and Vdata3 are "0", "0", and "0" respectively, as shown in FIG. 9, the light-emitting element L1 emits light during the periods of t1, x1, t2, x2, t3, and x3, and the picture of this frame is formed by superimposing the corresponding pictures. For example, in another example, if Vdata1, Vdata2, and Vdata3 are "1", "1", and "0", respectively, the light-emitting element L1 emits light only during the periods of t3 and x3, and the picture of this frame is formed by superimposing the corresponding pictures. It should be noted that Vdata1, Vdata2, and Vdata3 can be set as required, and are not limited to the setting modes described in the above examples, so each frame of picture can have multiple superimposing methods to meet the requirements for grayscale and improve the contrast.

In some embodiments of the present disclosure, the time data signals Vdata1, Vdata2, and Vdata3 determine whether the light-emitting element L1 emits light in a corresponding period, and the first light-emitting control signal EM1 and the second light-emitting control signal EM2 determine the light-emitting time in the corresponding period, the display data signal Vdata_d determines the magnitude of the driving current, so that the above parameters collectively control the display of each frame of picture.

It should be noted that this embodiment takes three scans (that is, three time data signals are written) within one frame as an example, but this does not constitute a limitation on the embodiments of the present disclosure. According to actual requirements, the number of scans can also be any number of times, such as 4 or 5.

It should be noted that in some embodiments of the present disclosure, the specific time length of t1, t2, t3, x1, x2, x3 is not limited, and the specific time length of t1+x1, t2+x2, t3+x3 is also not limited, which can be determined according to actual requirements and are not limited to the way described in the examples above. In addition, the specific time lengths of x1, x2, and x3 may be the same or different, which may be determined according to actual requirements, which is not limited in the embodiments of the present disclosure.

It should be noted, in this embodiment, the case that the third light-emitting control signal EM3 is different from the first light emission control signal EM1 is taken as an example for explanation. In other embodiments of the present disclosure, the third light-emitting control signal EM3 and the first light-emitting signal EM1 may be a same signal to reduce the number of signal lines. The third light-emitting control signal EM3 may also be another signal different from the waveform shown in FIG. 9, as long as the valid level interval of the third light-emitting control signal EM3 includes or is equal to the valid level interval of the first light-emitting control signal, which is not limited in the embodiment of the present disclosure.

Figure 10:
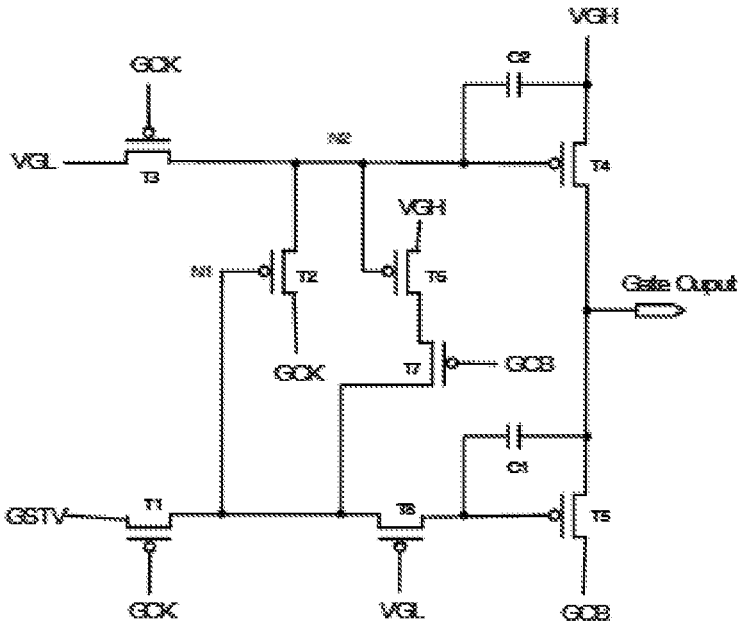
FIG. 10 is a schematic diagram of a shift register unit.
Figure 11:
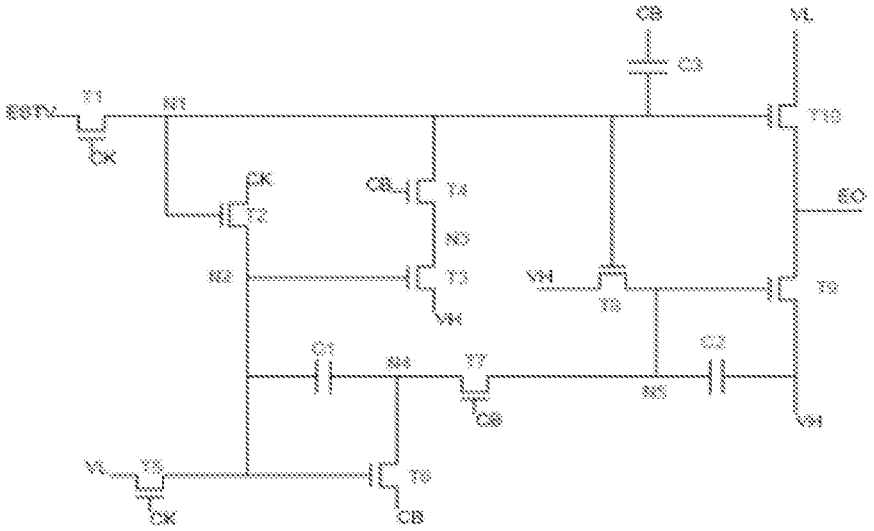
FIG. 11 is a schematic diagram of another shift register unit.

For example, the first light-emitting control signal EM1 and the second light-emitting control signal EM2 may be respectively provided by cascaded shift register units in a general gate driving circuit, for example, respectively provided by an 8T2C circuit as shown in FIG. 10, or respectively provided by a 10T3C circuit as shown in FIG. 11, or may also be provided by other applicable circuits, which are not limited in the embodiments of the present disclosure. Regarding the operation principles of the 8T2C circuit shown in FIG. 10 and the 10T3C circuit shown in FIG. 11 may refer to the conventional design, and details are not described herein. The following briefly describes the output signals of the 8T2C circuit shown in FIG. 10 in combination with the signal timing shown in FIG. 12.

Figure 12:
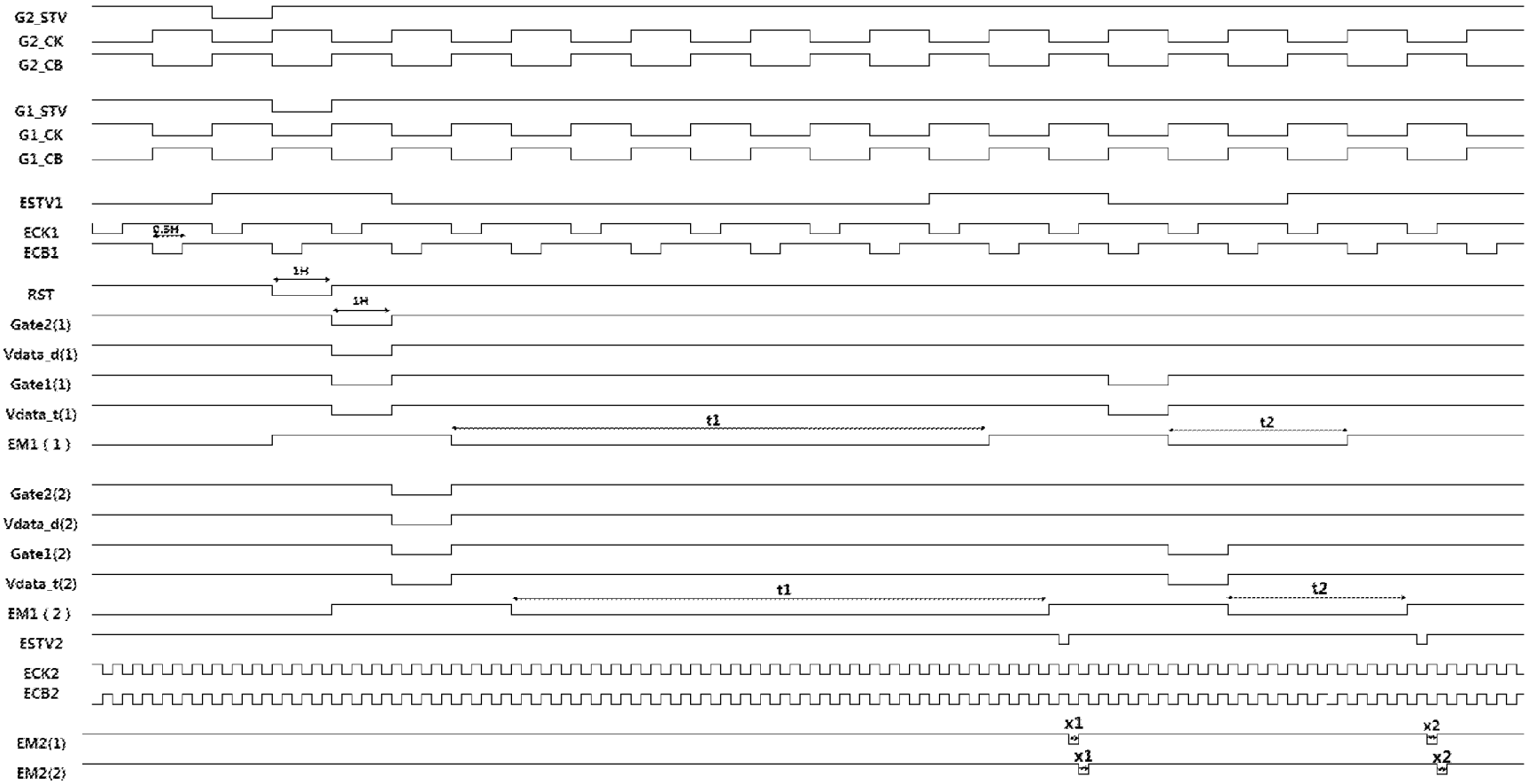
FIG. 12 is a signal timing diagram of a shift register unit.

For example, the first scanning signal Gate1, the second scanning signal Gate2, the first light-emitting control signal EM1, and the second light-emitting control signal EM2 are respectively provided by an 8T2C circuit, that is, four 8T2C circuits are used to provide the four signals, respectively. In FIG. 12, the signals of G1_STV, G1_CK, and G1_CB correspond to the signals of GSTV, GCK, and GCB in the 8T2C circuit that provides the first scanning signal Gate1; the signals of G2_STV, G2_CK, and G2_CB correspond to the signals of GSTV, GCK, and GCB in the 8T2C circuit that provides the second scanning signal Gate2; the signals of ESTV1, ECK1, and ECB1 correspond to the signals of GSTV, GCK, and GCB in the 8T2C circuit that provides the first light-emitting control signal EM1; the signals of ESTV2, ECK2, and ECB2 correspond to the signals of GSTV, GCK and GCB in the 8T2C circuit that provides the second emitting control signal EM2. For example, the signals of ECK1 and ECB1 have valid level pulse width of 0.5H and a duty cycle of 25%. FIG. 12 also shows signals corresponding to two adjacent rows of pixel units, in which Gate1 (1), Gate2 (1), EM1 (1), EM2 (1), Vdata_d (1), and Vdata_t (1) correspond to the first scanning signal Gate1, the second scanning signal Gate2, the first light-emitting control signal EM1, the second light-emitting control signal EM2, the display data signal Vdata_d and the time data signal Vdata_t of the pixel unit in the first row, Gate1 (2), Gate2 (2), EM1 (2), EM2 (2), Vdata_d (2) and Vdata_t (2) correspond to the first scanning signal Gate1, the second scanning signal Gate2, the first light-emitting control signal EM1, and the second light-emitting control signal EM2, the display data signal Vdata_d and the time data signal Vdata_t of the pixel unit in the second row.

As can be seen from FIG. 12, the valid level pulse widths of the first scanning signal Gate1 and the second scanning signal Gate2 are both 1H, and the valid level pulse width of the reset signal RST is also 1H. For example, the second scanning signal Gate2 of the adjacent previous row may be multiplexed as the reset signal RST of the current row. In this embodiment, for pixel unit of each row, the display data signal Vdata_d and the time data signal Vdata_t of the first scan are written in the same period, so more time can be reserved for subsequent operations, so that the light-emitting element L1 has longer luminous time. During the period of valid level pulse width of the first light-emitting control signal EM1 (for example, the t1 period or t2 period), the light-emitting element L1 emits light; after the first light-emitting control signal EM1 becomes the invalid level, the second light-emitting control signal EM2 becomes an valid level (such as the x1 period or the x2 period), the light-emitting element L1 continues to emit light, thereby realizing compensation for the light-emitting time, which makes the light-emitting time of the light-emitting element L1 become a binary unit duration.

Figure 13:
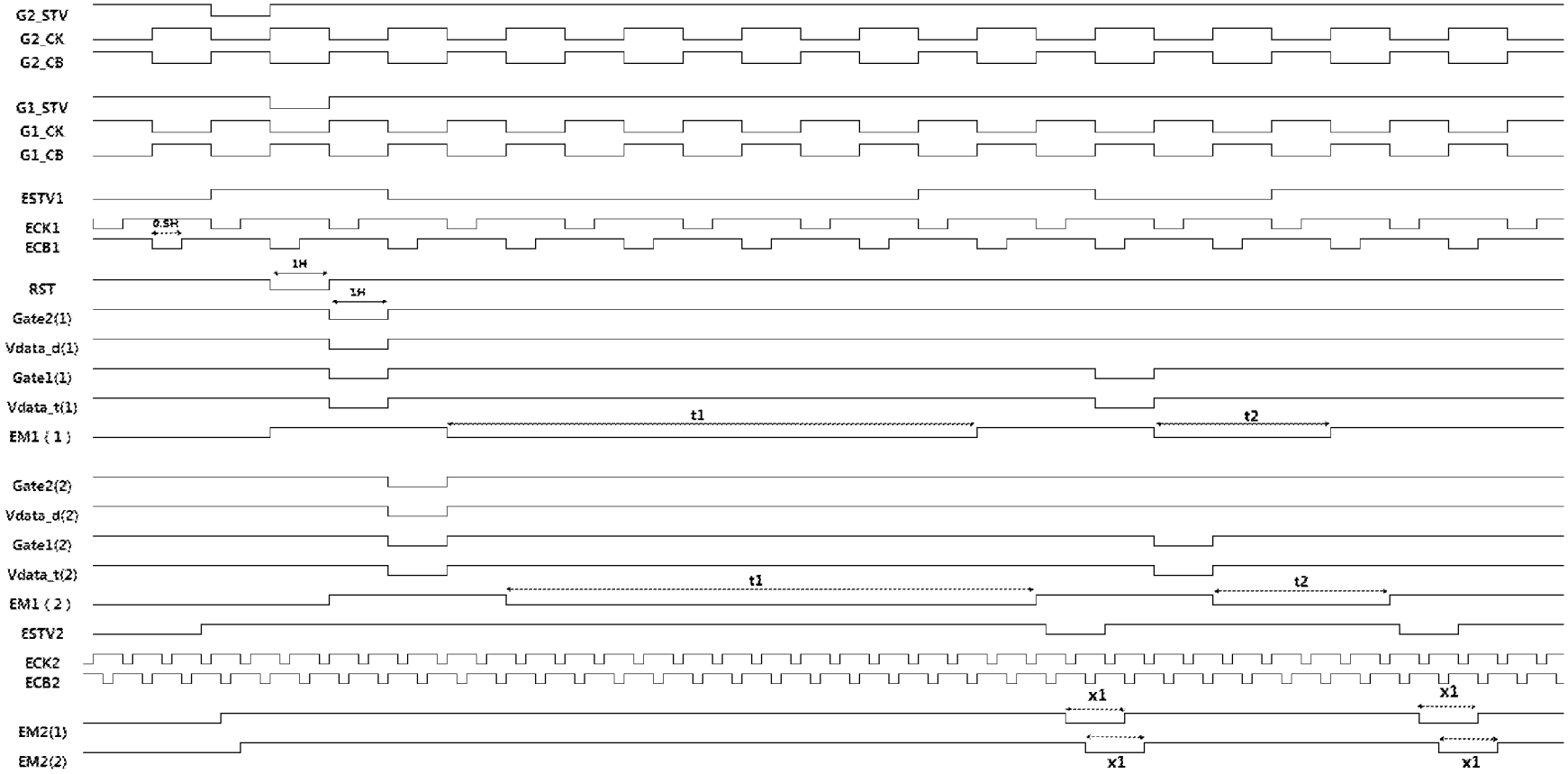
FIG. 13 is a signal timing diagram of another shift register unit.

Similarly, the 10T3C circuit shown in FIG. 11 may use the timing of the signals shown in FIG. 13 which is basically the same as the timing of the signals shown in FIG. 12, which is not repeated here. It should be noted that, in some embodiments of the present disclosure, the circuit structure of the shift register unit for providing the first light-emitting control signal EM1 and the second light-emitting control signal EM2 is not limited, accordingly, the timing of the signals and operation mode of which are also not limited, as long as it can provide the first light-emitting control signal EM1 and the second light-emitting control signal EM2 meeting the requirements. For example, the circuit structure of a shift register unit that provides the first light-emitting control signal EM1 and a shift register unit that provides the second light-emitting control signal EM2 may be the same or different, which is not limited in the embodiments of the present disclosure.

At least one embodiment of the present disclosure further provides a display panel including a plurality of pixel units distributed in an array. The pixel unit includes the pixel driving circuit according to any one of the embodiments of the present disclosure and a light-emitting element connected to the pixel driving circuit. The display panel can implement binary unit duration control in the case of multiple scans to improve the flexibility of the duration control, thereby achieving compensation for grayscale brightness and improving the display effect of the display panel.

Figure 14:
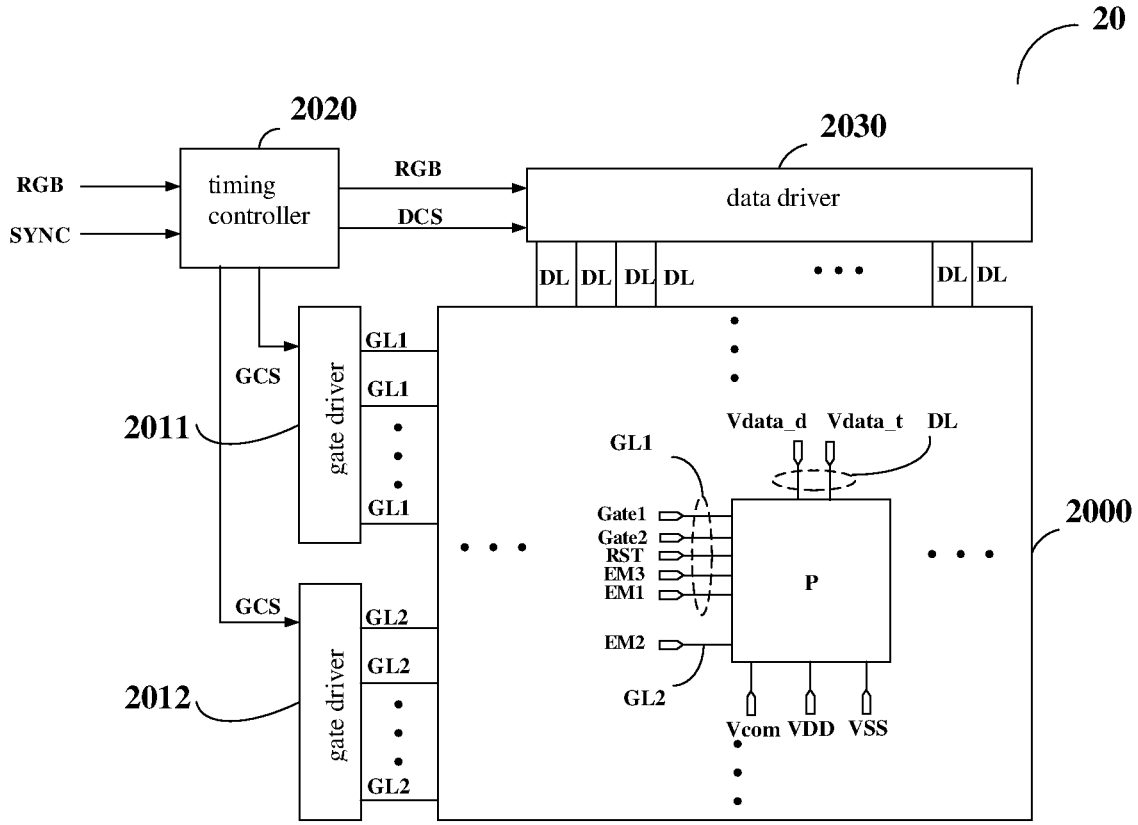
FIG. 14 is a schematic block diagram of a display panel provided by some embodiments of the present disclosure.

FIG. 14 is a schematic block diagram of a display panel provided by some embodiments of the present disclosure. As shown in FIG. 14, a display panel 2000 is arranged in a display device 20 and is electrically connected to gate drivers 2011 and 2012 and a data driver 2030. The display device 20 further includes a timing controller 2020. The display panel 2000 includes pixel units P that are defined according to the intersections of a plurality of scanning lines GL and a plurality of data lines DL; the gate driver 2011 is configured to drive the plurality of scanning lines GL1; the gate driver 2012 is configured to drive the plurality of scanning lines GL2; the data driver 2030 is configured to drive the plurality of data lines DL; the timing controller 2020 is configured to process the image data RGB input from the outside of the display device 20, to provide the data driver 2030 with the processed image data RGB and to output scan control signals GCS and a data control signal DCS to the gate drivers 2011, 2012 and the data driver 2030 to control the gate drivers 2011 and 2012 and the data driver 2030.

For example, the display panel 2000 includes a plurality of pixel units P, and the pixel unit P includes the pixel driving circuit 10 provided in any one of the above embodiments, for example, the pixel driving circuit 10 shown in FIG. 7 or FIG. 8. For example, the pixel unit P further includes a light-emitting element connected to the pixel driving circuit 10, and the light-emitting element is, for example, a light-emitting diode (for example, Micro LED). As shown in FIG. 14, the display panel 2000 further includes a plurality of scanning lines GL1, GL2 and a plurality of data lines DL. For example, the pixel unit P is arranged at the intersection region of the scanning lines GL1, GL2, and the data line DL. For example, each pixel unit P is connected to 5 scanning lines GL1 (providing a first scanning signal, a second scanning signal, a reset signal, a first light-emitting control signal, and a third light-emitting control signal, respectively), one scanning line GL2 (providing a second light-emitting control signal), two data lines DL (providing a display data signal and a time data signal, respectively), a first voltage line for providing a first voltage, a second voltage line for providing a second voltage, and a third voltage line for providing a third voltage. For example, the first voltage line, the second voltage line, or the third voltage line may be replaced with a corresponding plate-shaped common electrode (for example, a common anode or a common cathode). It should be noted that only a part of the pixel unit P, the scanning lines GL1, GL2, and the data lines DL are shown in FIG. 14.

For example, the display panel 2000 includes at least two gate driving circuits, for example, at least gate drivers 2011 and 2012, and the first light-emitting control signal and the second light-emitting control signal are provided by different gate driving circuit of the two gate driving circuits. For example, the first light-emitting control signal is provided by the gate driver 2011, and the second light-emitting control signal is provided by the gate driver 2012. Since the second light-emitting control signal is provided by a separate gate driver 2012 and does not need to be matched with other signals, the duration H can be achieved. For example, the gate driver 2011 may further include a plurality of gate driving sub-circuits for providing a first scanning signal, a second scanning signal, a reset signal, a first light-emitting control signal, a third light-emitting control signal, and the like, respectively. For example, the gate drivers 2011 and 2012 may be fabricated on an array substrate to form a gate-driver on array (GOA).

For example, the gate drivers 2011 and 2012 provide a plurality of strobe signals to the plurality of scanning lines GL1 and GL2 according to the plurality of scanning control signals GCS derived from the timing controller 2020. The plurality of strobe signals include a first scanning signal, a second scanning signal, a reset signal, a first light-emitting control signal, a second light-emitting control signal, a third light-emitting control signal, and the like. These signals are supplied to each pixel unit P through the plurality of scanning lines GL1, GL2.

For example, the data driver 2030 converts digital image data RGB input from the timing controller 2020 into display data signals and time data signals by using reference gamma voltages according to a plurality of data control signals DCS deriving from the timing controller 2020. The data driver 2030 provides the converted display data signals and time data signals to the plurality of data lines DL. For example, the data driver 2030 may also be connected to a plurality of first voltage lines, a plurality of second voltage lines, and a plurality of third voltage lines to provide the first voltage, the second voltage, and the third voltage, respectively.

For example, the timing controller 2020 processes the externally input image data RGB to match the size and resolution of the display panel 2000, and then provides the processed image data to the data driver 2030. The timing controller 2020 generates a plurality of scanning control signals GCS and a plurality of data control signals DCS by using synchronization signals (for example, a dot clock DCLK, a data enable signal DE, a horizontal synchronization signal Hsync, and a vertical synchronization signal Vsync) input from the outside of the display device 20. The timing controller 2020 provides the generated scanning control signals GCS and data control signals DCS to the gate drivers 2011, 2012 and the data driver 2030, respectively, for controlling the gate drivers 2011, 2012 and the data driver 2030.

For example, the gate drivers 2011, 2012 and the data driver 2030 may be implemented as a semiconductor chip. The display device 20 may further include other components, such as a signal decoding circuit, a voltage conversion circuit, and the like. For example, these components may use existing conventional components, which will not be described in detail here.

For example, the display panel 2000 can be applied to any product or component having a display function, such as an e-book, a mobile phone, a tablet computer, a television, a display, a notebook computer, a digital photo frame, a navigator, and the like. For example, the display panel 2000 may be a Micro LED display panel.

At least one embodiment of the present disclosure also provides a driving method of a pixel driving circuit according to any one of the embodiments of the present disclosure. By using the driving method, binary unit duration control can be implemented under multiple scans, and the flexibility of duration control is improved, thus achieving compensation for grayscale brightness and improving the display effect of the display panel.

For example, in one example, the driving method of the pixel driving circuit 10 includes the following operations: inputting a display data signal, a time data signal, a first light-emitting control signal, and a second light-emitting control signal, so that the current control circuit 100 controls the magnitude of the driving current flowing through the current control circuit 100 according to the display data signal, and the time control circuit 200 receives the driving current and controls the flowing time period of the driving current according to the time data signal, the first light-emitting control signal, and the second light-emitting control signal.

For example, in one example, the flowing time period of the driving current includes multiple durations corresponding to different display gray levels, and the multiple durations are binary unit durations (for example, 48H, 24H, 12H, 6H, 3H, etc. described above). For example, the pixel driving circuit 10 is connected to the light-emitting element 300, and the light-emitting element 300 receives and is driven by the driving current, and emits light according to the magnitude and the flowing time of the driving current.

It should be noted that, for a detailed description of the driving method, reference may be made to the description of the operation principles of the pixel driving circuit 10 and the display panel 2000 in the embodiments of the present disclosure, and details are not repeated here.

The following statements need to be noted:

(1) The accompanying drawings of the embodiments of the present disclosure relate only to the structures involved in some embodiments of the present disclosure, and other structures may be referred to general designs.

(2) In the case of no conflict, each embodiment of the present disclosure and features in the embodiments can be combined with each other to obtain new embodiments.

The foregoing is only a specific implementation of the present disclosure, the protection scope of the present disclosure is not limited thereto, and the protection scope of the present disclosure shall be subject to the protection scope of the claims.

What is claimed is:

1. A pixel driving circuit, comprising: a current control circuit and a time control circuit, wherein the current control circuit is configured to receive a display data signal and control a magnitude of a driving current flowing through the current control circuit according to the display data signal;

the time control circuit is configured to receive the driving current, and receive a time data signal, a first light-emitting control signal and a second light-emitting control signal, and control a flowing time period of the driving current according to the time data signal, the first light-emitting control signal and the second light-emitting control signal, wherein the time control circuit comprises a first light-emitting control circuit and a second light-emitting control circuit, the second light-emitting control circuit is connected in parallel with the first light-emitting control circuit, the time control circuit further comprises: a switching circuit, a time data writing circuit, and a first storage circuit;

the switching circuit comprises a control terminal and a first terminal, and is configured to be turned on or off to allow or not allow the driving current to pass through the switching circuit in response to the time data signal;

the time data writing circuit is connected to the control terminal of the switching circuit, and is configured to write the time data signal to the control terminal of the switching circuit in response to a first scanning signal;

the first storage circuit is connected to the control terminal of the switching circuit, and is configured to store the time data signal written by the time data writing circuit;

the first light-emitting control circuit is connected to the first terminal of the switching circuit, and is configured to apply the driving current to the first terminal of the switching circuit in response to the first light-emitting control signal;

the second light-emitting control circuit is also connected to the first terminal of the switching circuit, and is configured to apply the driving current to the first terminal of the switching circuit in response to the second light-emitting control signal.

2. The pixel driving circuit according to claim 1, wherein the time control circuit is connected to a light-emitting element, a time period for applying, by the first light-emitting control circuit and the switching circuit, the driving current to the light-emitting element to drive the light-emitting element to emit light is a first time period, a time period for applying, by the second light-emitting control circuit and the switching circuit, the driving current to the light-emitting element to drive the light-emitting element to emit light is a compensation time period, the flowing time period is a sum of the first time period and the compensation time period.

3. The pixel driving circuit according to claim 1, wherein the switching circuit comprises a first transistor;

a gate of the first transistor serves as the control terminal of the switching circuit, a first electrode of the first transistor serves as the first terminal of the switching circuit, and a second electrode of the first transistor is configured to be connected to the light-emitting element.

4. The pixel driving circuit according to claim 1, wherein the time data writing circuit comprises a second transistor;

a gate of the second transistor is configured to be connected to a first scanning line to receive the first scanning signal, and a first electrode of the second transistor is configured to be connected to a time data line to receive the time data signal, a second electrode of the second transistor is configured to be connected to the control terminal of the switching circuit.

5. The pixel driving circuit according to claim 1, wherein the first storage circuit comprises a first capacitor;

a first electrode of the first capacitor is configured to be connected to the control terminal of the switching circuit, a second electrode of the first capacitor is configured to be connected to a first voltage terminal to receive a first voltage.

6. The pixel driving circuit according to claim 1, wherein the first light-emitting control circuit comprises a third transistor;

a gate of the third transistor is configured to be connected to a first light-emitting control line to receive the first light-emitting control signal, a first electrode of the third transistor is configured to be connected to the current control circuit, a second electrode of the third transistor is configured to be connected to the first terminal of the switching circuit.

7. The pixel driving circuit according to claim 1, wherein the second light-emitting control circuit comprises a fourth transistor;

a gate of the fourth transistor is configured to be connected to a second light-emitting control line to receive the second light-emitting control signal, a first electrode of the fourth transistor is configured to be connected to the current control circuit, a second electrode of the fourth transistor is configured to be connected to the first terminal of the switching circuit.

8. The pixel driving circuit according to claim 1, wherein the current control circuit comprises a driving circuit, a display data writing circuit, and a second storage circuit;

the driving circuit comprises a control terminal, a first terminal, and a second terminal, and is configured to control a magnitude of the driving current according to the display data signal;

the display data writing circuit is connected to the first terminal of the driving circuit and is configured to write the display data signal to the first terminal of the driving circuit in response to a second scanning signal;

the second storage circuit is connected to the control terminal of the driving circuit, and is configured to store the display data signal written by the display data writing circuit.

9. The pixel driving circuit according to claim 8, wherein the current control circuit further comprises a compensation circuit, a third light-emitting control circuit, and a reset circuit;

the compensation circuit is connected to the control terminal and the second terminal of the driving circuit, and is configured to compensate the driving circuit in response to the second scanning signal and the display data signal written to the first terminal of the driving circuit;

the third light-emitting control circuit is connected to the first terminal of the driving circuit, and is configured to apply a second voltage of a second voltage terminal to the first terminal of the driving circuit in response to a third light-emitting control signal;

the reset circuit is connected to the control terminal of the driving circuit, and is configured to apply a reset voltage of a reset voltage terminal to the control terminal of the driving circuit in response to a reset signal.

10. The pixel driving circuit according to claim 9, wherein the compensation circuit comprises a seventh transistor;

a gate of the seventh transistor is configured to be connected to a second scanning line to receive the second scanning signal, a first electrode of the seventh transistor is configured to be connected to the control terminal of the driving circuit, and a second electrode of the seventh transistor is configured to be connected to the second terminal of the driving circuit.

11. The pixel driving circuit according to claim 9, wherein the third light-emitting control circuit comprises an eighth transistor;

a gate of the eighth transistor is configured to be connected to a third light-emitting control line to receive the third light-emitting control signal, a first electrode of the eighth transistor is configured to be connected to the second voltage terminal, a second electrode of the eighth transistor is configured to be connected to the first terminal of the driving circuit.

12. The pixel driving circuit according to claim 9, wherein the reset circuit comprises a ninth transistor;

a gate of the ninth transistor is configured to be connected to a reset signal line to receive the reset signal, a first electrode of the ninth transistor is configured to be connected to the control terminal of the driving circuit, a second electrode of the ninth transistor is configured to be connected to the reset voltage terminal.

13. The pixel driving circuit according to claim 8, wherein the driving circuit comprises a fifth transistor;

a gate of the fifth transistor serves as the control terminal of the driving circuit, a first electrode of the fifth transistor serves as the first terminal of the driving circuit, and a second electrode of the fifth transistor serves as the second terminal of the driving circuit and is configured to be connected to the time control circuit.

14. The pixel driving circuit according to claim 8, wherein the display data writing circuit comprises a sixth transistor;

a gate of the sixth transistor is configured to be connected to a second scanning line to receive the second scanning signal, and a first electrode of the sixth transistor is configured to be connected to a display data line to receive the display data signal, a second electrode of the sixth transistor is configured to be connected to the first terminal or the control terminal of the driving circuit.

15. The pixel driving circuit according to claim 8, wherein the second storage circuit comprises a second capacitor;

a first electrode of the second capacitor is configured to be connected to the control terminal of the driving circuit, a second electrode of the second capacitor is configured to be connected to the second voltage terminal to receive the second voltage.

16. A display panel, comprising a plurality of pixel units arranged as an array, wherein the pixel unit comprises the pixel driving circuit according to claim 1 and a light-emitting element connected to the pixel driving circuit.

17. The display panel according to claim 16, further comprising at least two gate driving circuits, wherein the first light-emitting control signal and the second emitting control signal are respectively provided by different gate driving circuits of the at least two gate driving circuits.

18. A driving method for a pixel driving circuit according to claim 1, comprising:

inputting the display data signal, the time data signal, the first light-emitting control signal, and the second light-emitting control signal, so that the current control circuit controls the magnitude of the driving current flowing through the current control circuit according to the display data signal, and the time control circuit receives the driving current and controls the flowing time period of the driving current according to the time data signal, the first light-emitting control signal and the second light-emitting control signal.

19. The driving method according to claim 18, wherein the flowing time period comprises a plurality of durations corresponding to different display gray levels, and the plurality of durations are binary unit durations.

20. The pixel driving circuit according to claim 1, wherein the current control circuit comprises a driving circuit, a display data writing circuit, and a second storage circuit;

the driving circuit comprises a control terminal, a first terminal, and a second terminal, and is configured to control a magnitude of the driving current according to the display data signal;

the display data writing circuit is connected to the control terminal of the driving circuit and is configured to write the display data signal to the control terminal of the driving circuit in response to a second scanning signal;

the second storage circuit is connected to the control terminal of the driving circuit, and is configured to store the display data signal written by the display data writing circuit.

* * * * *